US006102429A

United States Patent [19]

Laughlin et al.

[11] Patent Number: 6,102,429

[45] Date of Patent: Aug. 15, 2000

[54] STEP-IN SNOWBOARD BINDING

[75] Inventors: James Laughlin, Burlington; David J. Dodge, Williston, both of Vt.

[73] Assignee: The Burton Corporation, Burlington, Vt.

[21] Appl. No.: 09/442,779

[22] Filed: Nov. 18, 1999

Related U.S. Application Data

[63] Continuation of application No. 08/780,721, Jan. 8, 1997, which is a continuation-in-part of application No. 08/655,021, May 29, 1996, Pat. No. 5,722,680.

[51] Int. Cl.[7] ..... A63C 9/00

[52] U.S. Cl. ..... 280/617; 280/624

[58] Field of Search ..... 280/14.2, 607, 280/617, 618, 624, 625, 633

[56] References Cited

U.S. PATENT DOCUMENTS

| | | | |
|---|---|---|---|
| Re. 26,972 | 10/1970 | Spademan . | |
| Re. 33,350 | 9/1990 | Stuart . | |
| 3,140,877 | 7/1964 | Spademan . | |
| 3,271,040 | 9/1966 | Spademan . | |
| 3,280,411 | 10/1966 | Brock . | |
| 3,494,628 | 2/1970 | Spademan . | |
| 3,545,103 | 12/1970 | Bloomfield et al. . | |
| 3,560,011 | 2/1971 | Spademan . | |
| 3,797,841 | 3/1974 | McAusland . | |
| 3,824,713 | 7/1974 | Vaccari . | |
| 3,852,896 | 12/1974 | Pyzel et al. . | |
| 3,869,136 | 3/1975 | Jackson . | |
| 3,884,492 | 5/1975 | Spademan . | |
| 3,888,497 | 6/1975 | Zahradka . | |
| 3,900,204 | 8/1975 | Weber . | |
| 3,944,240 | 3/1976 | Bodendorfer . | |
| 3,957,280 | 5/1976 | Turnheim et al. . | |
| 3,972,134 | 8/1976 | Kastinger . | |
| 3,988,841 | 11/1976 | Salomon . | |
| 4,026,045 | 5/1977 | Druss . | |
| 4,042,257 | 8/1977 | Salomon | 280/624 |
| 4,155,179 | 5/1979 | Weninger . | |
| 4,177,584 | 12/1979 | Beyl . | |

(List continued on next page.)

FOREIGN PATENT DOCUMENTS

| | | |
|---|---|---|
| 0 397 969 A1 | 11/1990 | European Pat. Off. . |
| 0 669 147 A2 | 8/1995 | European Pat. Off. . |
| 2732230 | of 0000 | France . |

(List continued on next page.)

*Primary Examiner*—Robert J. Oberleitner
*Assistant Examiner*—Pamela J. Lipka
*Attorney, Agent, or Firm*—Wolf, Greenfield & Sacks, P.C.

[57] ABSTRACT

A snowboard binding for securing a snowboard boot to a snowboard. According to one aspect of the invention, the binding comprises a base, a first engagement member that is movably mounted to the base and is adapted to engage a first lateral side of the boot, and a second engagement member that is movably mounted to the base and is adapted to engage a second lateral side of the boot opposite the first lateral side of the boot. According to another aspect of the invention, the snowboard binding includes a high-back leg support mounted to the base. According to a further aspect of the invention, the binding includes a pair of engagement fingers, adapted to engage a lateral side of the boot and including a front engagement finger and a rear engagement finger, the pair of engagement fingers being pivotally mounted to the base for movement between an open position and a closed position, the pair of engagement fingers being mounted so that the rear engagement finger extends a greater distance above the baseplate than the front engagement finger when the engagement fingers are in the open position. In another aspect of the invention, the binding includes an over-center locking mechanism adapted to lock the movable engagement member in the closed position, the locking mechanism including a roller that is mechanically coupled to the movable engagement member and a cammed socket adapted to receive the roller when the movable engagement member is in the closed position.

148 Claims, 12 Drawing Sheets

U.S. PATENT DOCUMENTS

| | | | |
|---|---|---|---|
| 4,182,525 | 1/1980 | Spademan . | |
| 4,270,770 | 6/1981 | Spademan . | |
| 4,352,508 | 10/1982 | Spademan . | |
| 4,356,170 | 10/1982 | Carpenter et al. . | |
| 4,387,517 | 6/1983 | Annovi . | |
| 4,395,055 | 7/1983 | Spademan . | |
| 4,403,785 | 9/1983 | Hottel . | |
| 4,492,387 | 1/1985 | Spademan | 280/624 |
| 4,652,007 | 3/1987 | Dennis . | |
| 4,669,202 | 6/1987 | Ottieri . | |
| 4,728,116 | 3/1988 | Hill . | |
| 4,741,550 | 5/1988 | Dennis . | |
| 4,964,649 | 10/1990 | Chamberlin . | |
| 4,973,073 | 11/1990 | Raines et al. . | |
| 4,979,760 | 12/1990 | Derrah . | |
| 5,016,902 | 5/1991 | Goud et al. . | |
| 5,020,823 | 6/1991 | Bogner | 280/634 |
| 5,024,457 | 6/1991 | Bogner | 280/632 |
| 5,028,068 | 7/1991 | Donovan . | |
| 5,035,443 | 7/1991 | Kincheloe . | |
| 5,044,654 | 9/1991 | Meyer . | |
| 5,044,656 | 9/1991 | Peyre | 280/618 |
| 5,054,807 | 10/1991 | Fauvet . | |
| 5,069,463 | 12/1991 | Baud et al. . | |
| 5,085,455 | 2/1992 | Bogner et al. . | |
| 5,094,470 | 3/1992 | Riedel . | |
| 5,121,939 | 6/1992 | Peyre . | |
| 5,143,396 | 9/1992 | Shaanan et al. | 280/607 |
| 5,145,202 | 9/1992 | Miller . | |
| 5,172,924 | 12/1992 | Barci . | |
| 5,176,397 | 1/1993 | Bogner et al. | 280/632 |
| 5,188,386 | 2/1993 | Schweizer . | |
| 5,213,356 | 5/1993 | Rohrmoser . | |
| 5,232,241 | 8/1993 | Knott et al. . | |
| 5,236,216 | 8/1993 | Ratzek . | |
| 5,299,823 | 4/1994 | Glaser | 280/625 |
| 5,344,179 | 9/1994 | Fritschi et al. . | |
| 5,354,088 | 10/1994 | Vetter et al. . | |
| 5,356,170 | 10/1994 | Carpenter et al. | 280/618 |
| 5,401,041 | 3/1995 | Jespersen . | |
| 5,409,244 | 4/1995 | Young . | |
| 5,417,443 | 5/1995 | Blattner et al. . | |
| 5,474,322 | 12/1995 | Perkins et al. . | |
| 5,480,176 | 1/1996 | Sims . | |
| 5,499,461 | 3/1996 | Danezin et al. . | |
| 5,505,477 | 4/1996 | Turner et al. . | |
| 5,544,909 | 8/1996 | Laughlin et al. | 280/617 |
| 5,577,757 | 11/1996 | Riepl et al. . | |
| 5,690,351 | 11/1997 | Karol . | |
| 5,727,797 | 3/1998 | Bowles . | |

FOREIGN PATENT DOCUMENTS

| | | |
|---|---|---|
| 2 628 981 | 9/1989 | France . |
| 2 644 074 | 9/1990 | France . |
| 2 652 753 | 4/1991 | France . |
| 2 689 776 | 10/1993 | France . |
| 4435960 | of 0000 | Germany . |
| 38 04 383 A1 | 8/1989 | Germany . |
| 3910156 A1 | 10/1990 | Germany . |
| 43 11 630 | 8/1994 | Germany . |
| 4344647 A1 | 6/1995 | Germany . |
| 295 16 279 | 2/1996 | Germany . |
| 322456 | 11/1934 | Italy . |
| 7-303728 | 11/1995 | Japan . |
| 678494 A5 | 9/1991 | Switzerland . |
| WO 96/05894 | 2/1996 | WIPO . |
| WO 96/26774 | 6/1996 | WIPO . |
| WO 96/03185A1 | 8/1996 | WIPO . |

STEP-IN SNOWBOARD BINDING

CROSS-REFERENCE TO RELATED APPLICATIONS

This application is a continuation of U.S. patent application Ser. No. 08/780,721, filed Jan. 8, 1997 entitled "Step-In Snowboard Binding," and now pending, which is a continuation-in-part of U.S. patent application Ser. No. 08/655,021, filed May 29, 1996, now U.S. Pat. No. 5,722,680.

BACKGROUND OF THE INVENTION

1. Field of the Invention

The present invention relates to a snowboard binding for interfacing a boot to a snowboard.

2. Discussion of the Related Art

Most conventional binding systems for soft snowboard boots are not "step-in" systems that can be automatically actuated by the rider simply stepping into the binding. These bindings typically include a rigid high-back piece into which the heel of the boot is placed, and one or more straps that secure the boot to the binding. Such bindings can be somewhat inconvenient to use because after each run, the rider must unbuckle each strap to release the boot when getting on the chair lift, and must re-buckle each strap before the next run.

Other soft boot bindings have been developed that do not employ straps, but use rigid engagement members to releasably engage the boot to the binding. These systems typically include a handle or lever that must be actuated to move one of the engagement members into and out of engagement with the snowboard boot, and therefore, are not step-in systems that are automatically actuated by the rider simply stepping into the binding. The requirement that the handle or lever be mechanically actuated to lock the boot into the binding makes it less convenient and more time consuming to engage the rider's boots to the snowboard each time the rider completes a run.

Further, more conventional bindings that employ rigid engagement members and an actuation handle or lever generally employ a large spring that biases the binding to hold it in the closed position. Thus, to open the binding, the rider must exert substantial force on the handle or lever, making the binding difficult to use.

In view of the foregoing, it is an object of the present invention to provide an improved step-in binding for mounting a boot to a snowboard.

SUMMARY OF THE INVENTION

In accordance with one illustrative embodiment of the invention, a snowboard binding is provided for securing a snowboard boot to a snowboard. The binding comprises a base, a first engagement member, movably mounted to the base, adapted to engage a first lateral side of the boot, and a second engagement member, movably mounted to the base, adapted to engage a second lateral side of the boot opposite the first lateral side of the boot.

In another illustrative embodiment of the invention, a snowboard binding is provided that comprises a base, a first engagement member, mounted to the base, adapted to engage a first lateral side of the boot, a second engagement member, moveably mounted to the base, adapted to engage a second lateral side of the boot opposite the first lateral side of the boot, and a high-back leg support mounted to the base.

In a further illustrative embodiment, a snowboard binding is provided comprising a base including a baseplate adapted to receive a sole of the snowboard boot; a first engagement member, mounted to the base, adapted to engage a first lateral side of the boot; and a pair of engagement fingers, adapted to engage a second lateral side of the boot opposite the first lateral side of the boot, the pair of engagement fingers including a front engagement finger and a rear engagement finger, the pair of engagement fingers being pivotally mounted to the base for movement between an open position and a closed position, the pair of engagement fingers being mounted so that the rear engagement finger extends a greater distance above the baseplate than the front engagement finger when the engagement fingers are in the open position.

In another illustrative embodiment of the invention, a snowboard binding is provided that comprises a base; a movable engagement member, mounted to the base, adapted to move between an open position and a closed position wherein the movable engagement member secures the boot in the binding; and an over-center locking mechanism adapted to lock the movable engagement member in the closed position, the locking mechanism including a cammed surface that is mechanically coupled to the movable engagement member and a cammed socket adapted to receive the cammed surface when the movable engagement member is in the closed position, the locking mechanism being arranged so that any lifting force generated on the movable engagement member by the snowboard boot when the engagement member is in the closed position acts to seat the cammed surface in the cammed socket, thereby maintaining the engagement member in the closed position.

BRIEF DESCRIPTION OF THE DRAWINGS

The invention will be better understood and appreciated from the following detailed description of illustrative embodiments thereof, and the accompanying drawings, in which.

DETAILED DESCRIPTION

The present invention is directed to a method and apparatus for engaging a snowboard boot to a snowboard. In accordance with one illustrative embodiment of the invention, a binding is provided that is automatically closed when a rider steps into the binding. Furthermore, the binding advantageously provides substantial locking force while requiring a small opening force.

Figure 1:
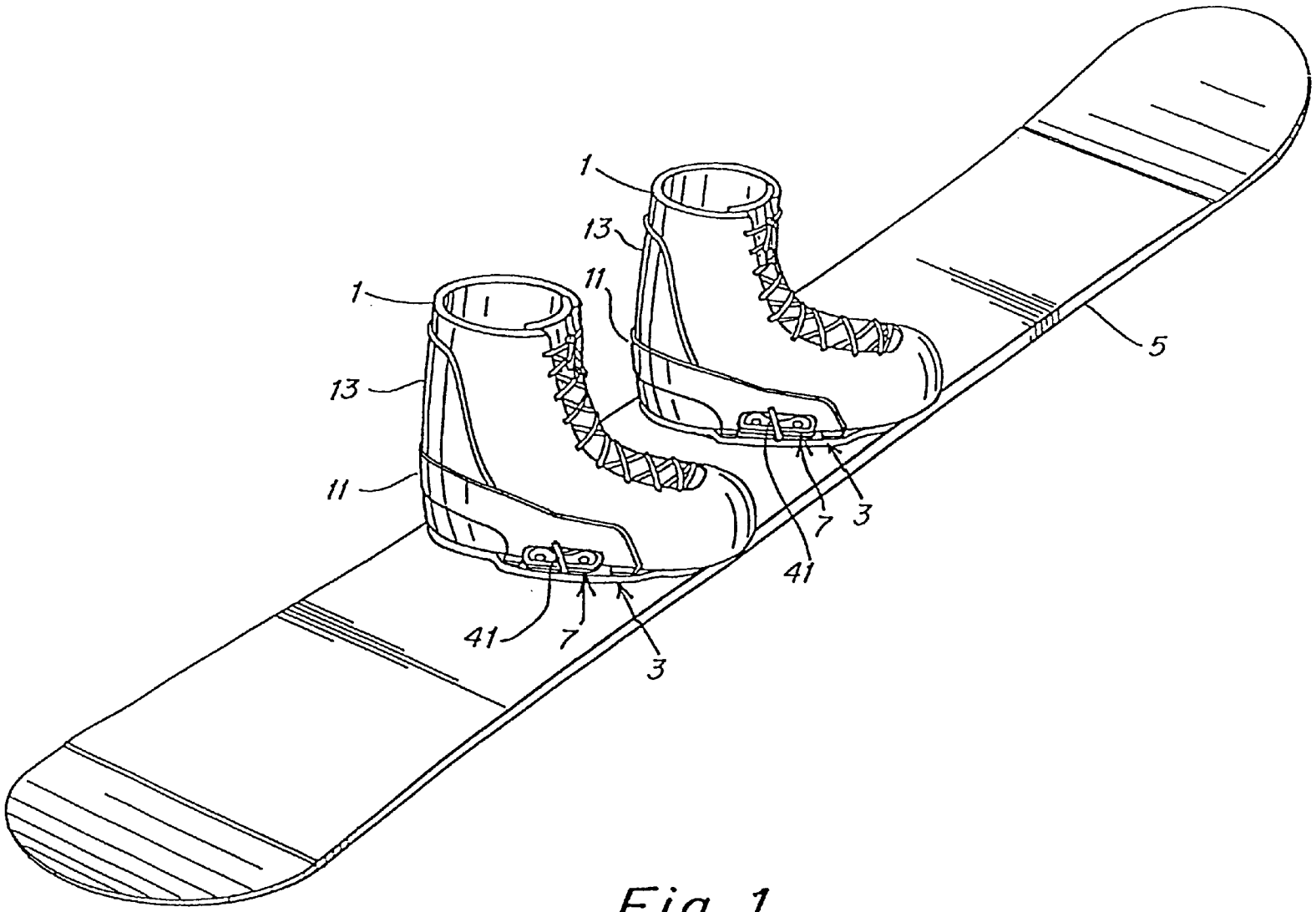
FIG. 1 is a perspective view of two bindings in accordance with the present invention, each mounted on a snowboard and receiving a boot.

FIG. 1 is a schematic perspective view of a pair of snowboard boots 1 mounted to a snowboard 5 via a pair of bindings 3 in accordance with one illustrative embodiment of the present invention. The bindings 3 each includes a pair of engagement members for engaging the lateral sides of the boots, and a handle 41. The binding is constructed and arranged so that the engagement members automatically lock the boot 1 in the binding when the rider steps into the binding, without requiring actuation of the handle 41. The handle 41 is used only to move the binding from a locked position to an unlocked position, and can do so without substantial force from the rider.

The binding of the present invention enables quick and easy engagement and disengagement of the rider's boots with the board. Before beginning a run, the rider simply steps into the bindings 3, which causes the engagement members to automatically secure the boots 1 to the board 5. At the completion of the run, the rider can lift the handle 41 of the rear binding to disengage the binding and free the rear boot, thereby enabling the rider to use the rear leg to push the snowboard along to the chair lift. After the handle 41 is lifted and the rider steps out, the binding 3 automatically assumes the open position wherein it is prepared to receive and automatically engage the boot. Thus, after getting off the lift, the rider can simply step into the binding to automatically lock the boot in place, and begin the next run.

Although the binding of the present invention is not limited in this respect, it provides a significant advantage when a high-back leg support is attached to the binding. In particular, some boot and binding systems, including some soft boot step-in systems, attach the high-back to the boot, rather than to the binding in the conventional manner. These systems typically include a binding engagement member disposed on each lateral side of the binding for engagement with a corresponding mating feature on the snowboard boot. Conventionally, the binding engagement member on one side of the boot is fixed and the engagement member on the other is moveable from an open position that enables the rider to step into the binding to a closed position that locks the boot in the binding. To step into such a binding, the rider typically lowers his or her boot downward from a position directly above the binding and aligns the corresponding mating feature of the boot with the fixed engagement member. The rider then steps down with the other side of the boot, which may activate a trigger to move the moveable engagement member into the closed position if the binding is a step-in system. If the binding is not a step-in design, the rider actuates a handle or lever to move the binding into the closed configuration.

To align the mating feature of the boot with the fixed engagement member in the above-described conventional binding system, the rider typically must angle the boot toward the side of the binding on which the fixed engagement member is mounted, such that the boot is lower initially on that side of the binding than on the other. Only after the fixed engagement member is mated with the corresponding feature on the boot does the rider step down and lower the other side of the boot into engagement with the binding. This stepping in process is relatively simple when the high-back is mounted to the boot. However, difficulty would be encountered in stepping into a binding with a fixed engagement member if the high-back were mounted directly to the binding. In particular, the high-back is conventionally angled upwardly and forwardly from the heel of the binding, such that a high-back mounted to the binding would present an obstacle to the rider in attempting to lower the boot into the binding while also angling the boot in the manner necessary to align its mating features with the binding's fixed engagement member. Although it may be possible for the rider to make this alignment and complete the process of stepping into the binding, the stepping in process would be more uncomfortable and difficult than is desired.

To address the foregoing concern, one embodiment of the present invention is directed to a step-in binding wherein the engagement member on each side is moveable from an open to a closed position. Although not limited in this respect, this embodiment of the present invention facilitates the process of stepping into the binding when the binding includes an attached high-back. Attaching the high-back directly to the binding, rather than the boot, results in a boot and binding system that is more conventional and familiar to riders, because as discussed above, conventional strap bindings for soft snowboard boots typically include a high-back that is attached at the heel of the binding. In addition, removing the high-back from the boot makes the boot simpler to construct and more comfortable to walk in, which is a significant feature to riders who have become accustomed to the ease of walking in soft snowboard boots.

Figure 2:
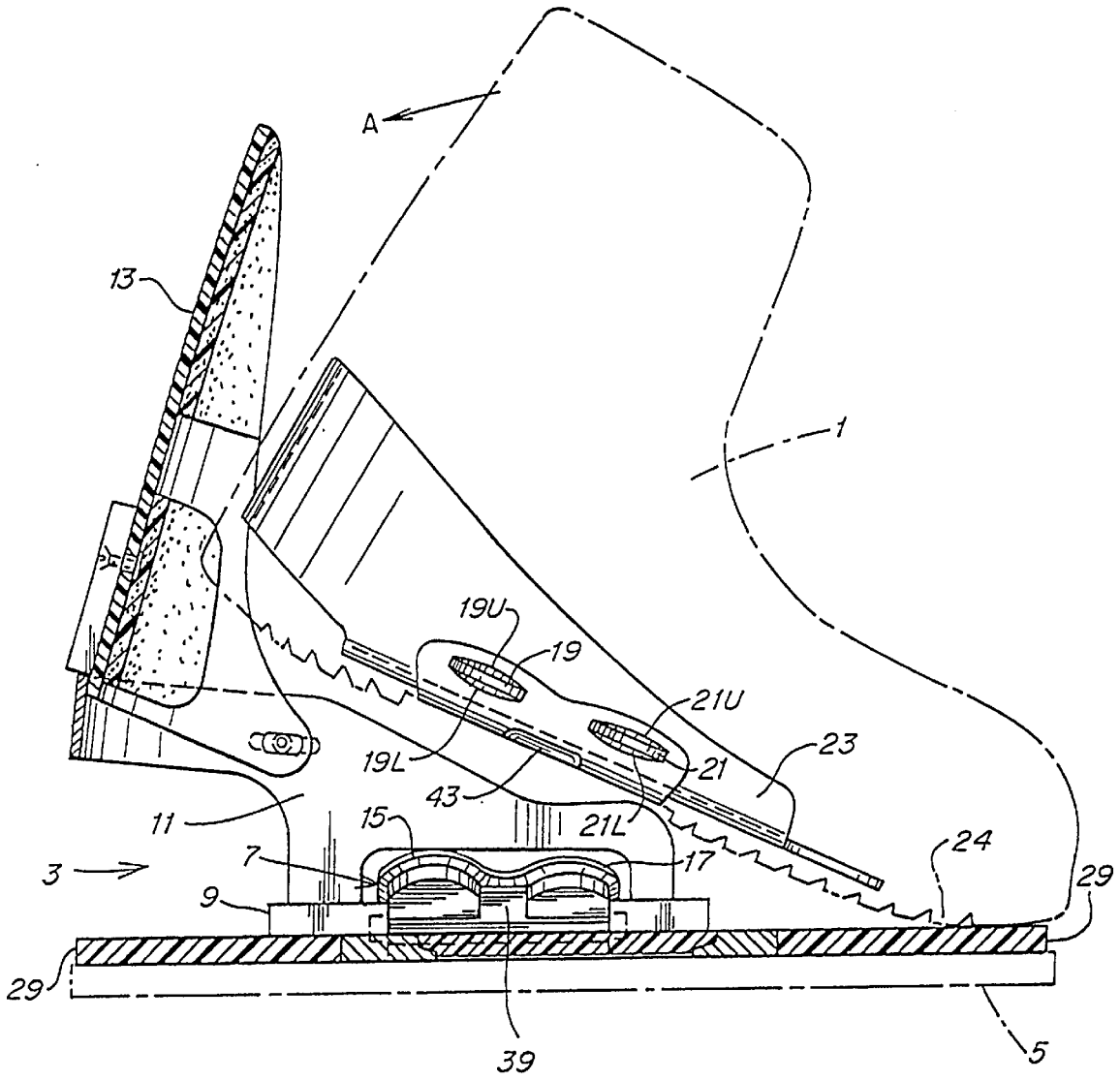
FIG. 2 is a cross-sectional view, taken along line 2—2 of FIG. 3, showing the manner in which a rider steps into a binding according to one embodiment of the present invention.

FIGS. 2–11 illustrate one embodiment of a binding in accordance with the present invention. The manner in which the rider steps into the binding is described making reference to FIG. 2, which illustrates snowboard boot 1 in the process of stepping into the binding 3 that is mounted to snowboard 5. FIG. 2 is a cross-sectional side view of the binding showing only one of the pair of moveable engagement members 7 in an open position. The binding 3 further includes a baseplate 9 to which the moveable engagement member 7 is mounted, as well as a heel hoop 11 that is also mounted to the baseplate. In the embodiment shown, the engagement members 7 are rotatably mounted to the binding plate 9 for rotation between the open position of FIG. 2, wherein the engagement member is rotated upwardly away from the boot, to a closed position shown in FIG. 6A, wherein the engagement member has rotated downwardly into a position wherein it engages the boot and extends in a substantially horizontal configuration essentially parallel to the baseplate 9.

In the embodiment shown in the figures, each moveable engagement member 7 has a pair of engagement fingers 14 and 17, and is adapted to engage a snowboard boot having a pair of recesses 19 and 21 disposed on the medial and lateral sides of the boot. The lateral recesses may be provided in the boot via an interface 23, as described in co-pending U.S. patent application Ser. No. 08/584,053 which is incorporated herein by reference, which is a single-piece molded plastic part bonded to the sole of the boot. However, it should be understood that the invention is not limited in this respect, and that the binding of the present invention can be used with boots that are adapted in other ways to engage the binding engagement members. Furthermore, although the use of two spaced apart engagement fingers on one side of the boot is advantageous in that it strengthens the engagement between the binding and the boot, particularly when the boot recesses are formed in a plastic interface, it should be understood that the present invention is not limited to a binding that uses an engagement member with dual engagement fingers on one side of the boot.

To step into the binding of FIGS. 2–11, the engagement member 7 on each side of the binding is first set to the open position in a manner discussed below. Thereafter, the rider places the boot in front of the binding and slides the heel rearwardly in the direction shown by arrow A in FIG. 2. When sliding the boot rearwardly into the binding, the rider maintains the ball area of the foot 24 in contact with a pad 29 that is disposed on the board for reasons discussed below and slides the boot rearwardly until the heel engages the high-back leg support, at which point the recesses 19 and 21 are aligned with and disposed above the engagement fingers 15 and 17. At this point, the rider steps down with the heel of the boot, triggering the moveable engagement members 7 in a manner described below so that they move into engagement with the boot and lock the rider into the binding.

When the rider steps into the binding in the manner discussed above, the boot is angled as shown in FIG. 2, such that the heel of the boot is raised with respect to the baseplate by a greater amount than the toe. In one embodiment of the invention, the binding is adapted, in a manner discussed below, to facilitate engagement with the boot in this orientation. In particular, as shown in FIG. 2, when the binding is in the open configuration, the rear engagement finger 15 extends above the baseplate 9 by a greater amount than the front engagement finger 17, thereby conforming to the configuration of the rear and front recesses 19 and 21 as the rider steps into the binding. However, in the closed configuration, the rear and forward engagement fingers 15 and 17 are level (i.e., extend above the baseplate by the same amount) to match the configuration of the boot recesses once the heel of the boot has stepped down onto the binding plate.

The embodiment of the present invention shown in FIGS. 2–11 is a binding assembly that includes a number of features that, although advantageous, are not essential. For example, the assembly includes a hold-down disc 25 (FIG. 3) that is received in an opening (not shown) in the binding baseplate 9, and includes a number of holes for accommodating screws 27 that attach the binding to the snowboard 5. The hold-down disc enables the rotational orientation of the baseplate to be adjusted relative to the board. The binding assembly further includes the pad 29 which is disposed both forwardly and rearwardly of the baseplate 9. The pad 29 has a thickness substantially equal to the thickness of the baseplate, and assists in providing a stable footing area for the boot when received in the binding. A high-back 13 may be attached to the heel hoop 11 on each side of the binding via a screw 31, with an accompanying nut 33, that is received in an elongated slot 35. The slot 35 enables the attachment point of the binding along each side of the binding to be adjusted forwardly and rearwardly. This adjustability enables the binding to be rotated about an axis that is substantially normal to the baseplate 9, which provides a number of advantages as described in U.S. Pat. No. 5,356,170, which is incorporated herein by reference.

Figure 3:
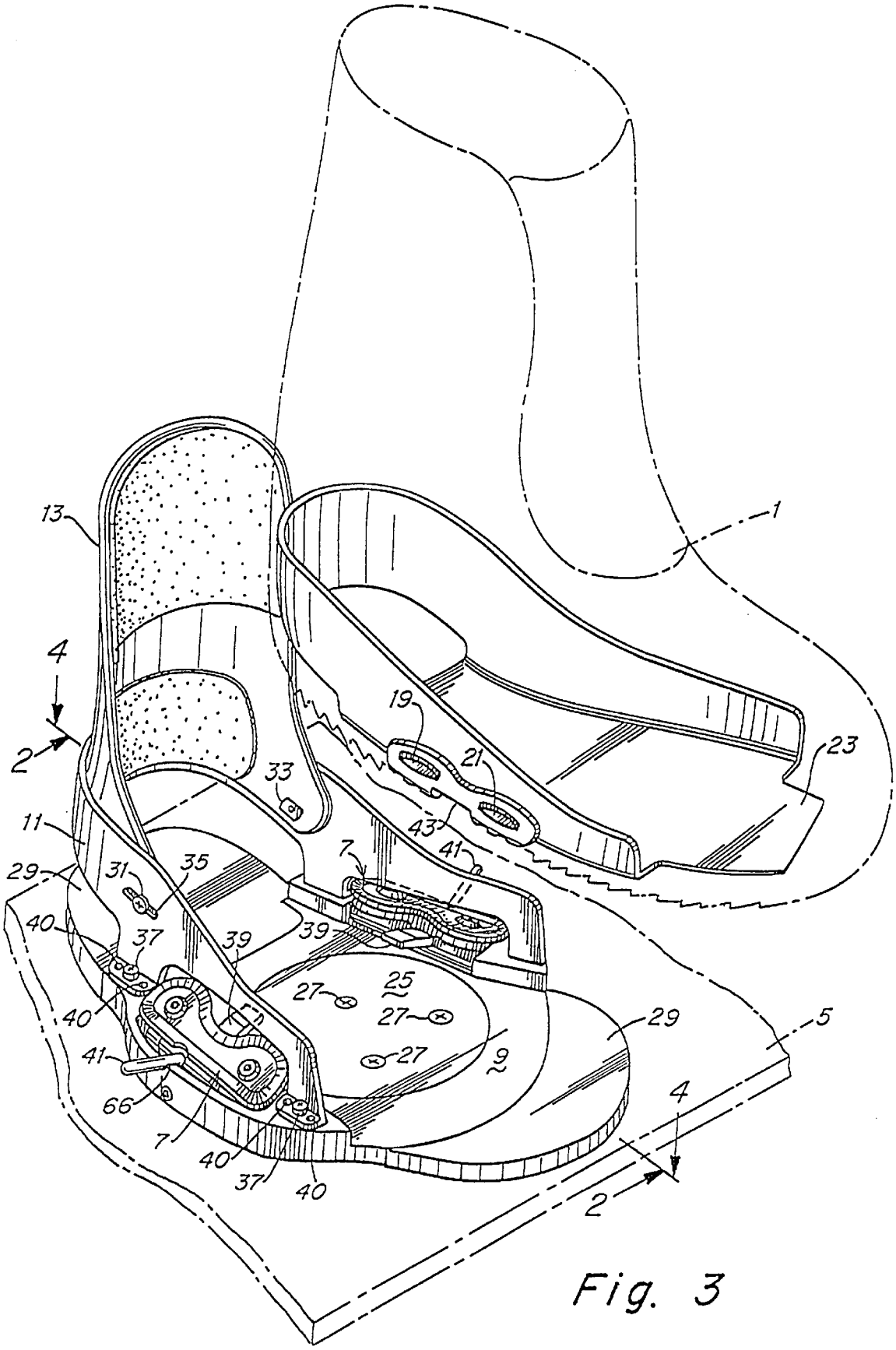
FIG. 3 is a perspective view of the dual-lever embodiment of the present invention.
Figure 4:
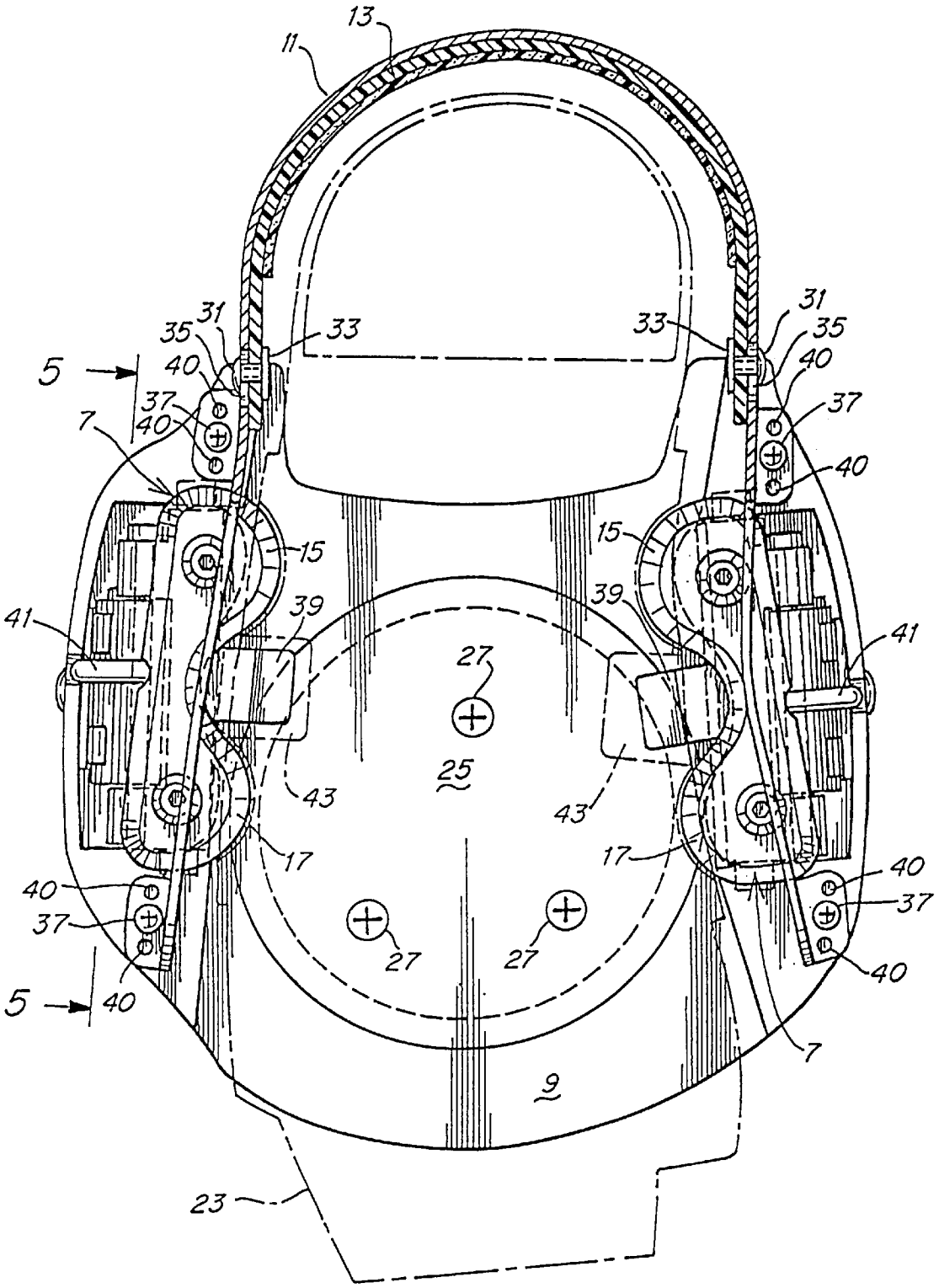
FIG. 4 is a top view of the binding of FIG. 3.

The heel hoop 11 is mounted to the baseplate 9 via a set of four screws 37 (FIGS. 3–4). In one embodiment of the invention, an adjustability feature is provided so that the position of the heel hoop can be adjusted along the longitudinal axis of the baseplate 9. In this manner, a single heel hoop and baseplate combination can be adjusted to accommodate boots of different sizes. In the embodiment shown, the adjustability feature is provided via a plurality of holes 40 being provided on the heel hoop 11 for each screw 37. However, it should be understood that the adjustability feature can be provided in a number of other ways, such as by providing a plurality of spaced holes in the baseplate, rather than the heel hoop, for receiving each screw 37.

As discussed above, one embodiment of the invention includes a moveable engagement member 7 disposed on both the medial and lateral sides of the binding. These engagement members are identical to those described in co-pending U.S. patent application Ser. No. 08/655,021, now U.S. Pat. No. 5,722,680, which is incorporated herein by reference. As shown in the figures, in one embodiment of the invention the engagement fingers are adapted to be compatible with a boot in which the upper surfaces 19U and 21U (FIGS. 2 and 6A–C) of the boot recesses are angled upwardly from the back of the recess to the edge of the boot and the lower recess surfaces 19L and 21L are angled downwardly, so that each recess is widened at its outer periphery to make it easier to insert the engagement member 7. The lower surface of each engagement finger 15 and 17 may also be angled upwardly to match the angle of the lower recess surfaces 19L and 21L, as shown at 17L in FIG. 6A, to further facilitate mating of the recesses with the engagement members. When these angles are matched, the lower surface 17L of the engagement member lies flush against the lower surface 21L of the recess when the binding is closed. Examples of angles suitable for the recess surfaces and the engagement member fingers include angles ranging from 10–25°. However, it should be understood that the present invention is not limited to any particular range of angles or even to requiring that the recess and/or engagement fingers be angled at all. All that is required is that the engagement member and recess have compatible shapes that enable the rider to step into the binding and provide sufficient engagement forces to hold the boot in the binding when the binding is closed.

Each of the moveable engagement members 7 is mechanically coupled to a trigger 39 in a manner discussed below, such that when the rider steps down on the trigger 39, the engagement fingers 15 and 17 are moved into engagement with the recesses on the side of the boot. In one embodiment of the invention, the binding includes an active locking mechanism for each engagement member, so that after the rider steps down on the trigger 39 and advances it past an unstable trigger point, the locking mechanism actively brings the moveable engagement member 7 into a fully closed position, wherein the binding is closed and the boot is held between the engagement members on the medial and the lateral sides of the binding. Thereafter, the binding can be opened by actuating the pair of handles 41, which are also mechanically coupled to the engagement members in a manner described below.

Figure 6A:
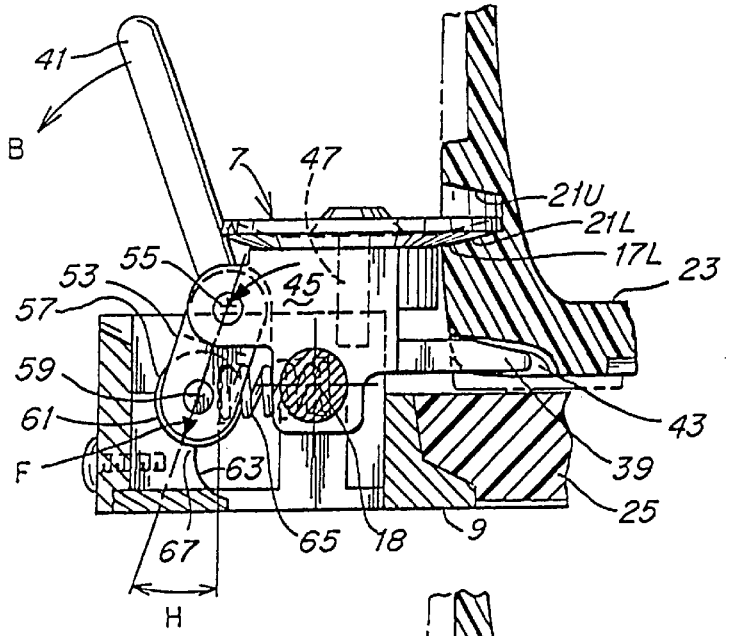
FIG. 6A is a cross-sectional view, taken along 6—6 of FIG. 5, showing the locking mechanism in the closed position.
Figure 10:
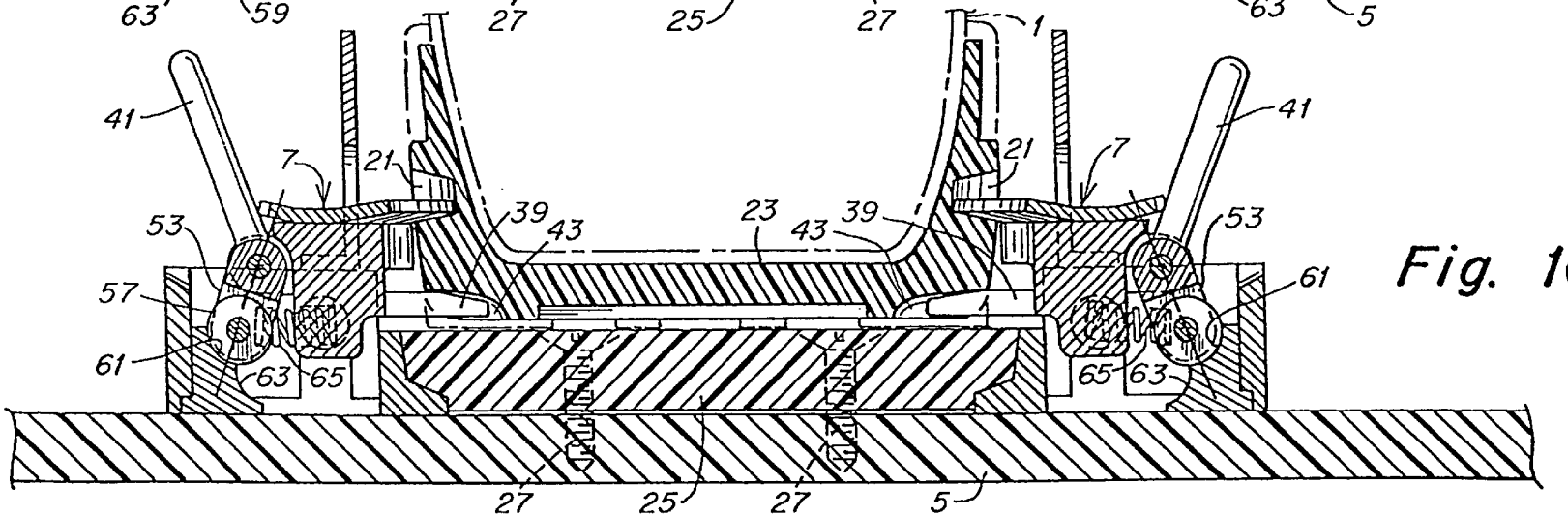
FIG. 10 is a cross-sectional view, taken along line 9—9 of FIG. 8, showing a boot engaged by the dual-lever embodiment of the present invention with both locking mechanisms in the closed position.
Figure 11:
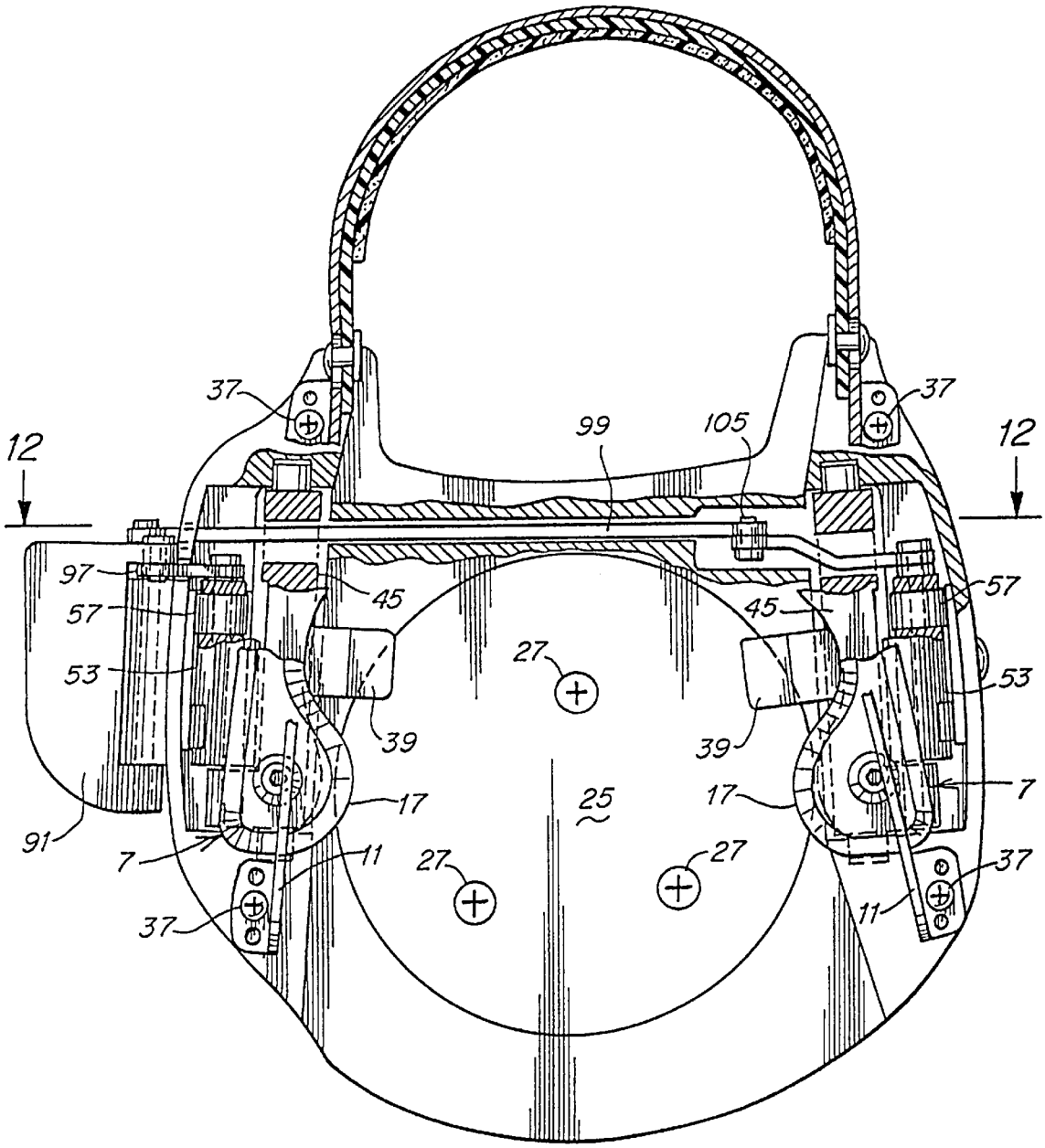
FIG. 11 is a partially cut-away top plan view of the single-lever embodiment of the present invention.

In the embodiments shown in the figures, the boot 1 is provided with a sole recess 43 (FIGS. 2 and 6A–6C) on each side of the boot that is adapted to receive the trigger 39. This recess can be provided in the interface 23, or in any number of other ways. The recess 43 permits the bottom of the boot to sit flat on the binding plate 9 when the binding is fully closed, as shown in FIGS. 6A and 10, without interference from the trigger 39. Furthermore, the rider can use the recesses 43 to align the boot with the binding to ensure that the boot is properly positioned to receive the end of the engagement members 7 when the rider steps down on the triggers. However, although the sole recesses provide a number of advantages, it should be understood that the invention is not limited to use with a boot that includes such recesses. For example, the binding mechanism can be constructed so that the trigger does not extend parallel to the binding plate in the locked position, but rather, is received in a recess provided in the binding plate when the binding is in the locked position.

In the illustrative embodiments of the invention shown in the figures, the binding includes a rocker 45 that mechanically couples the engagement member 7 to the trigger 39. The rocker is pivotally mounted, about an axis 18 (FIGS. 5 and 6A–C), to the baseplate 9. The trigger 39 is fixed to the rocker 45. These parts can be formed from a single molded plastic piece or from other suitable materials. In the embodiment shown, the engagement member 7 is a metal piece that is fixedly attached to the rotatable rocker by a pair of rods 47. The rods 47 extend through holes in the engagement member 7 and rocker 45, and are peened over a washer (not shown) underneath the rocker. It should be understood that the engagement members can alternatively be attached to the binding in a number of other ways. For example, the engagement members 7 can also be injection molded as a part of a one-piece part including the rocker 45 and trigger 39.

The rocker 45, engagement member 7 and trigger 39 are arranged so that when the binding is in the open position, the rider can step into the binding and onto the trigger 39 in the manner described above without interference from the engagement member 7. Furthermore, as the binding moves into the closed position, the member 7 is brought into engagement with the boot recesses 19 and 21. The rocker 45, engagement member 7 and trigger 39 are preferably dimensioned and configured so that the boot, trigger and engagement member mesh together like a gear when the rider steps into the binding. In one embodiment of the invention, the rocker 45, and consequently the trigger 39 and engagement member 7 that are fixed thereto, rotates from the open to the closed position through an Angle G (FIG. 6C) equal to approximately 30°. However, it should be understood that by altering the dimensions of the trigger 39 and engagement member 7, as well as the angle of rotation of the rocker, a number of different configurations can be achieved. All that is required that the binding be arranged so that when it is in the open position, the rider can step into the binding and onto the trigger 39 without interference from the engagement member 7, and so that stepping onto the trigger causes the member 7 to be brought into engagement with the boot recesses as the heel is advanced downwardly into the binding.

The shape of the sole recess 43 (FIGS. 6A–6C) on the boot can be manipulated to control the rate at which the engagement member 7 closes as the boot steps down on the trigger. In the embodiments shown, the upper surface of the recess is arched from the inside of the foot to the outside and matches a radius on the upper surface of the trigger. In one embodiment, the radius for each arc is approximately 15 mm. The arc on the upper surface of the recess causes the engagement member to close more quickly than if the recess was formed in a rectangular shape. The trigger extends slightly beyond the engagement member, and in one embodiment has a length of approximately 25 mm.

To accomplish the above-described objective of conforming the configuration of the engagement fingers 15 and 17 to the boot recesses as the rider steps into the binding, each engagement member 7 is mounted to the rocker 45 at an angle relative to the rocker's axis of rotation, such that the rear engagement fingers 14 are displaced from the rocker's rotation axis by a greater amount toward the boot than are the front engagement fingers 17. As a result of this offsetting of the engagement fingers from the rocker's rotation axis, when the rocker pivots to the open position, the rear engagement fingers 14 rise higher above the surface of the baseplate than do the front engagement fingers 17. In one embodiment of the invention shown in FIG. 7, each engagement member 7 is disposed relative to the rocker such that a line 73 passing through the center points 75 for the radii that define the engagement fingers 15 and 17 is offset at an angle C relative to the rocker's axis of rotation 77. In one embodiment of the invention, the angle C has a value within a range from 0–15°, and in one particular embodiment is equal to approximately 6.1°.

It should be understood that the boot is shaped differently on the medial and lateral sides. Thus, to ensure that the engagement members 7 properly mate with the boot on both sides, in one embodiment of the invention the orientation of the axes of rotation for the rocker differs on the medial and lateral sides of the binding. In particular, each rocker is oriented so that in the closed position, the center 75 of the radius for each of the engagement fingers is disposed at approximately the center of the radius for its corresponding boot recess 19, 21. On the lateral side, the boot is angled such that the line 73 passing through the two center points 75 of the engagement fingers and recesses is disposed at an angle D relative to the center axis of the binding plate. In one embodiment of the invention, the recesses disposed on the lateral side of the boot are arranged such that the angle D is equal to approximately 4.5°. On the medial side, the line 73 passing through the center points 75 of the engagement fingers and recesses is disposed at a sharper angle E relative to the center line of the boot. In one embodiment of the invention, the angle E is equal to approximately 12.6°.

As should be appreciated from the foregoing, to ensure that the engagement fingers have the above-described orientation relative to the center-line of the binding when in the closed configuration, and to ensure that the rear engagement member rises up in the open configuration to meet the rider's boot when the heel is raised above the binding plate, the rockers are mounted to the binding plate such that their axes of rotation 77 are angled relative to the center axis of the binding plate. In particular, on the lateral side of the boot, the rocker is mounted so that its axis of rotation is disposed at an angle A equal to approximately 1.6°, with this angle being determined by subtracting the 4.5° angle D required to be compatible with the angle of the recesses in the boot from the 6.1° angular offset that ensures that the rear engagement finger rises higher than the forward engagement member when the binding is open. Similarly, the rocker is disposed on the medial side of the boot at an angle B equal to approximately 6.5° determined by subtracting the 6.1° angular offset that accomplishes the rising up of the rear engagement member from the 12.6° angle that matches the medial side of the boot.

In an alternate embodiment of the invention, the relative arrangements of the engagement members on the medial and lateral sides of the binding can be further adjusted to facilitate engagement with the boot when the rider steps into the binding. In particular, it has been discovered that when stepping into a binding, some riders angle their boot such that the medial side of the boot is lower (i.e., closer to the binding plate) in the heel area than the lateral side. Thus, in one embodiment of the invention, the binding is arranged such that in the open position, the rear engagement finger on the lateral side of the binding rises higher than the rear engagement finger on the medial side. It should be appreciated that this can be accomplished by altering the angles C at which the engagement fingers are mounted relative to the rocker's axis of rotation such that the angle is greater on the lateral side than on the medial side.

The description above is provided merely for illustrative purposes, and it should be understood that the angles of the rockers relative to the binding plate and of the engagement fingers relative to the rockers can be varied without departing from the scope of the present invention.

Figure 5:
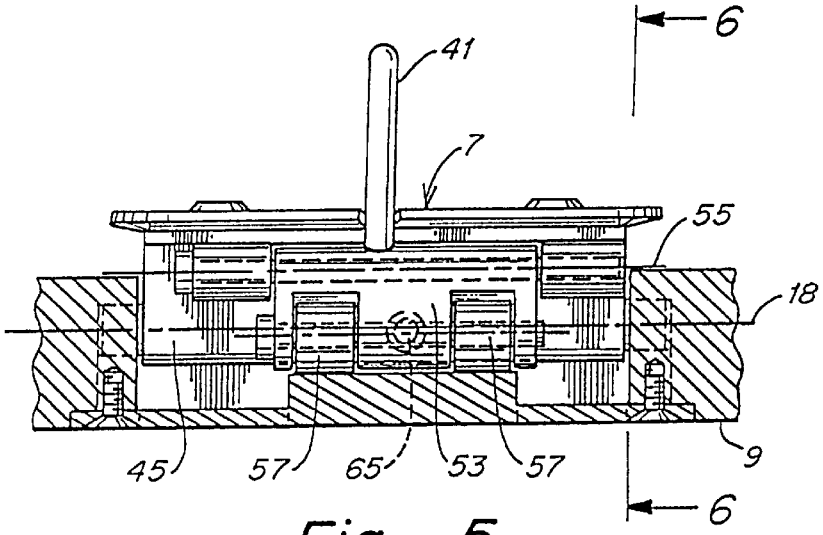
FIG. 5 is a cross-sectional view, taken along line 5—5 in FIG. 4, of a binding locking mechanism in accordance with one embodiment of the invention.

The mechanism that locks the pivotal engagement member 7 into the closed position on each side of the binding is now described making reference to FIGS. 5–10. The locking mechanism includes the lever 41 and rocker 45 discussed above, and an arm 53 that is integrally connected (i.e., fixed) to the lever. The lever and arm are pivotally mounted to the rocker 45 about an axis 55 (FIGS. 6A–C). A pair of rollers 57 is in turn pivotally attached to the arm 53 about an axis 59. The rollers 57 are adapted to engage with a pair of cammed sockets in the baseplate, including an upper cammed socket 61 and a lower cammed socket 63. In the embodiment shown in the figures, the cammed sockets 61 and 63 are formed via a separate piece that is screwed into engagement with the binding plate. However, it should be understood that other arrangements are possible, and that the cammed sockets 61 and 63 can be integrally formed into the baseplate, such as by molding the entire baseplate and cammed structure as a single piece. Furthermore, in the embodiment shown, the cammed sockets 61 and 63 each is a contiguous surface that engages both rollers 57 which, as shown in FIG. 5, are disposed on opposite sides of the lever 41. However, it should be understood that each of the cammed sockets 61 and 63 can alternatively be split into a pair of sockets each adapted to engage only one of the rollers 57.

In the embodiment shown in the drawings, the rollers each provides a cammed surface adapted to mate with the cammed sockets 61 and 63. However, it should be understood that pivotal rollers are not required. In this respect, the arm 53 can be provided with cammed surfaces that do not roll relative to the arm, but are adapted to mate with the cammed sockets 61 and 63 and perform the same function as the rollers 57.

Figure 6B:
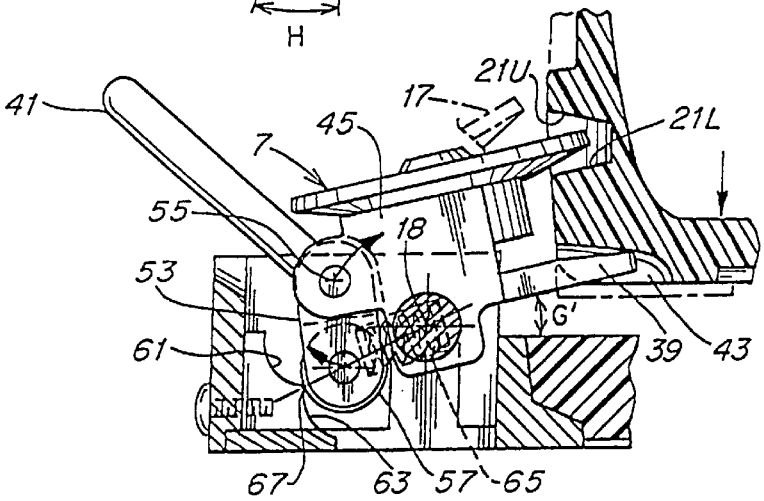
FIG. 6B is a cross-sectional view, taken along 6—6 of FIG. 5, showing the locking mechanism in the ready-to-lock position.
Figure 6C:
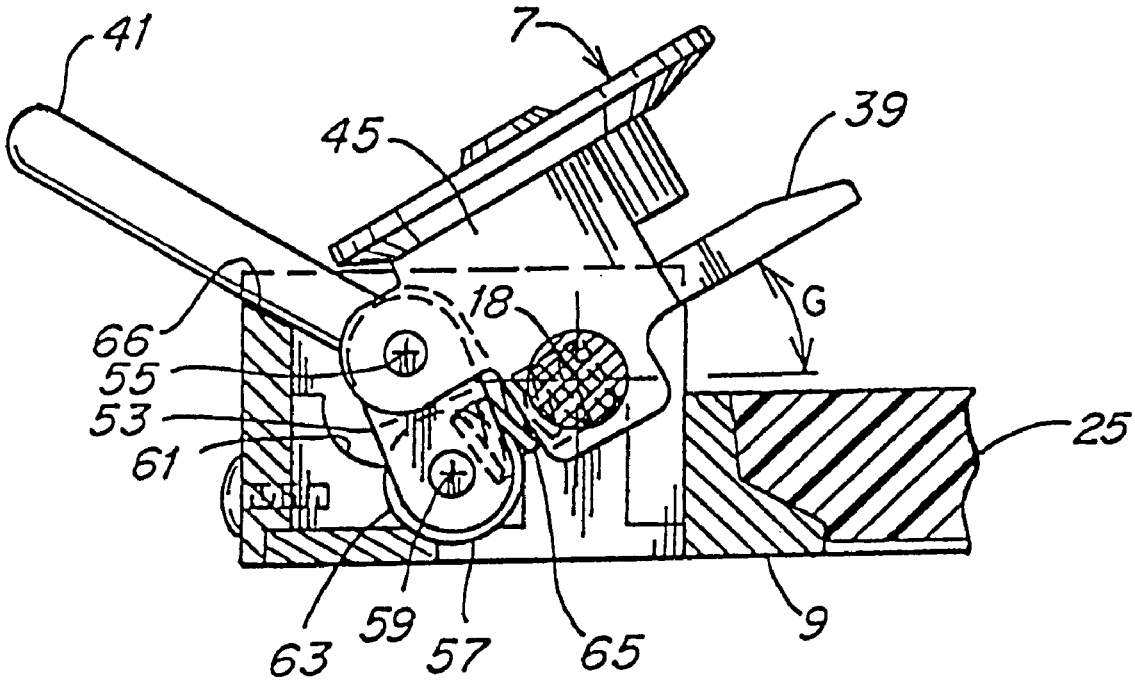
FIG. 6C is a cross-sectional view, taken along 6—6 of FIG. 5, showing the locking mechanism in the open position.
Figure 7:
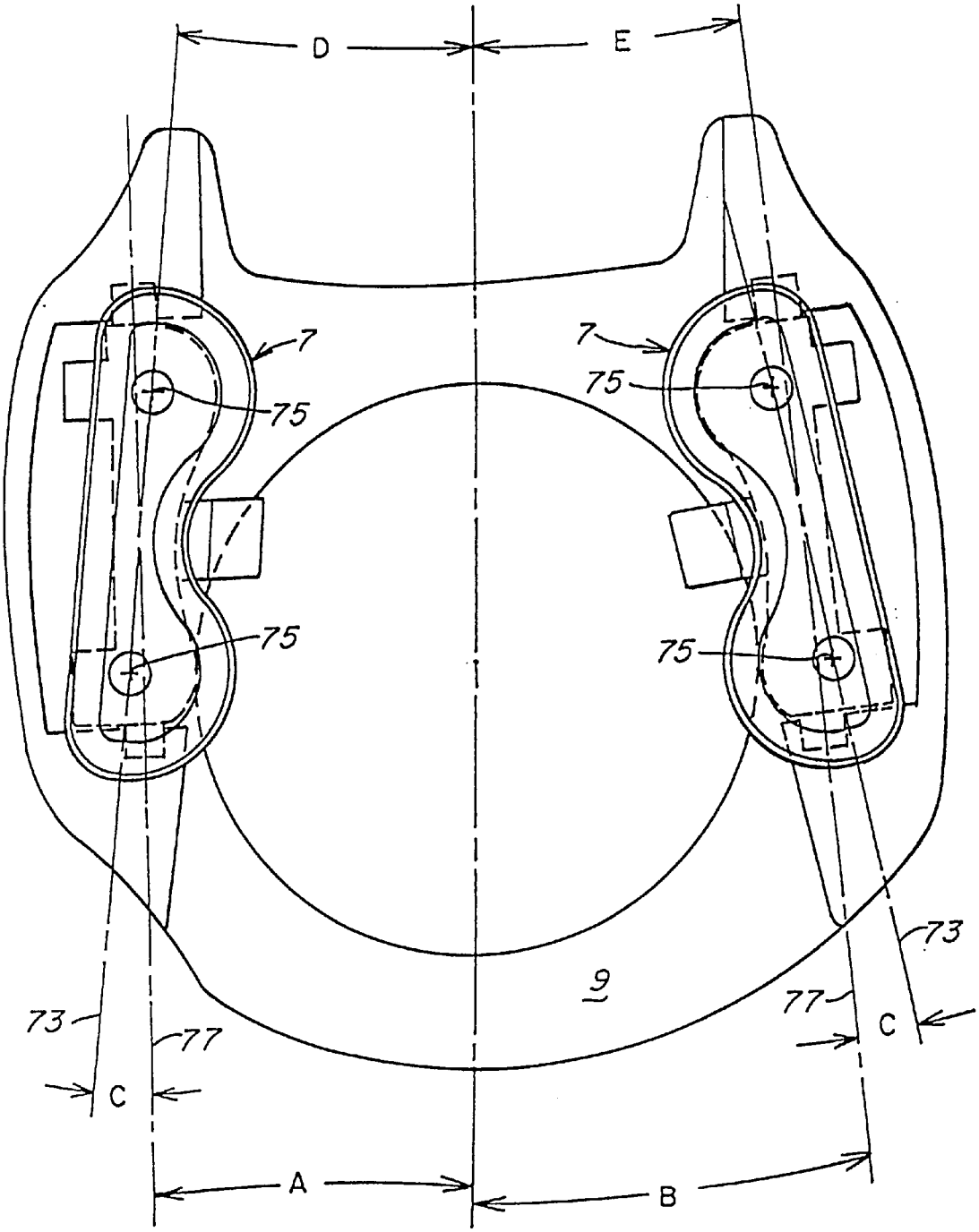
FIG. 7 is a simplified top view showing a number of angles relevant to the mounting of the engagement members and rockers of the locking mechanism in accordance with one embodiment of the present invention.

When the binding is in the open position depicted in FIG. 6C, the rollers 57 are seated within the lower cammed socket 63. The binding is held in the open position by a compression spring 65 that is disposed in a channel between the rocker 45 and the arm 53. The spring 65 acts to push the arm and rocker away from each other. Thus, when the rollers 57 are seated in the lower cammed socket 63, the spring prevents the rocker from rotating in the clockwise direction in FIG. 6C about its pivot axis 18, thereby keeping the rocker in the open position. Counterclockwise rotation of the rocker 45 is limited by engagement of the lever 41 with a groove 66 in a sidewall of the baseplate configured to receive the lever 41.

FIG. 6B illustrates the movement of the locking components as the rider steps into the binding and onto the trigger 39. In FIG. 6B, the inner surface of the trigger recess 43 of the rider's boot 1 has contacted and displaced the trigger 39 approximately 10° in the clockwise direction so that the Angle G between the bottom of the trigger and the binding plate is approximately 20°. Since the rocker 45 and engagement member 7 are fixed to the trigger 39, they also rotate through approximately 10°. This rotation of the rocker 45 in the clockwise direction about the pivot axis 18 causes the pivot axis 55 about which the arm 53 is mounted to the rocker to rise, which in turn causes the rollers 57 attached to the arm 53 to rise out of the lower cammed socket 63 to the position shown in FIG. 6B, wherein the rollers 57 are contacting a peak 67 between the upper and lower cammed sockets 61 and 63. In the position of FIG. 6B, the contact between the rollers and the cammed sockets is unstable, in that the rollers are not seated in either of the cammed sockets. In this position, the force of the compression spring 65 automatically causes the rollers to snap into the position shown in FIG. 6A, in which the locking mechanism locks the engagement member 7 in the boot recesses 19 and 21 to lock the boot in the binding.

In the fully locked position of FIG. 6A, the rollers 57 are seated in the upper cammed socket 61. When a lifting force from the boot is generated that would tend to rotate the rocker counterclockwise into the open position, the rocker translates the force along a force line F (FIG. 6A) that extends between the axes 55 and 59 about which the arm is respectively mounted to the rocker 45 and the rollers 57. This line of force acts to seat the rollers 57 in the cammed socket 61, thereby preventing the rocker from rotating counterclockwise and the binding from opening. In this respect, all that is theoretically required to ensure that the rollers 57 will remain seated in the cammed socket 61 is that the curved surface that defines the cammed socket 61 extend in the counterclockwise direction in FIG. 6A by some small number of degrees beyond the point where the force line F passes through the cammed socket 61. In one embodiment of the invention, the cammed socket 61 continues for approximately 5–20° beyond this point of intersection with the force line F to ensure that despite manufacturing tolerances, the rollers 57 will remain seated in the socket despite the application of lifting forces on the binding engagement member 7 during a ride. It should be appreciated that the locking mechanism is an over-center arrangement because once the trigger 39 has been depressed sufficiently so that the rollers 57 advance past the peak 67 and into the upper cammed socket 61, any lifting force on the binding tends to seat the rollers 57 in the upper cammed socket 61, thereby maintaining the binding in the closed configuration. Furthermore, this locking mechanism is advantageous in that if the material forming the cammed socket 61 deflects in response to the application of a lifting force on the engagement member 7, such deflection serves not to open the binding, but rather to seat the roller 57 in the cammed socket even more firmly, thereby ensuring that the locking mechanism will remain locked.

As seen from the foregoing, it is the shapes and configurations of the cammed socket 61 and the rollers 57 that ensure that the binding will remain locked, such that the compression spring 65 is not necessary to keep the binding locked. Once the binding is locked, it would remain so even if the spring was not present. Thus, the spring 65 need only provide sufficient force to hold the binding open as discussed above in connection with FIG. 6C, and to snap the binding into the locked position from the unstable position of FIG. 6B when the trigger has been sufficiently depressed. As a result, the spring does not present significant resistance to the rider when attempting to open the binding.

To open the locking mechanism, the rider applies a downward force on the lever 41 in the direction shown by arrow B in FIG. 6A. This force on the lever 41 translates partially into a downward force along the force line F, which does not act to open the binding as discussed above. However, the force on the lever 41 also translates to a moment that causes the lever 41, and arm 53 that is attached thereto, to rotate in the counterclockwise direction in FIG. 6A about the axis 55 that mounts the arm 53 to the rocker 45. Once this moment is sufficient to overcome the force of the compression spring 65, the arm 53 rotates counterclockwise about axis 55, thereby moving the rollers 57 out of their engagement with the cammed socket 61. Once the rollers 57 move a sufficient distance out of the cammed surface 61 so that the line of force F passes the peak 67 that defines the end of the cammed socket 61, the rollers 57 come free of the upper socket and move into the open configuration of FIG. 6C.

As should be appreciated from the foregoing, the over-center configuration of the above-described embodiment of the present invention provides secure engagement of the rider's boot, such that the binding will not inadvertently open during riding. Thus, each engagement member 7 locks the boot in the binding in a non-releasable manner, i.e., the binding will not release during a run. However, only a relatively small amount of force is necessary for the rider to open the binding when desired. To rotate the lever to the open position, the rider must only overcome the relatively small force of the compression spring that biases the lever, and then generate sufficient force to move the rollers 57 out of the over-center position.

The levers on both sides of the binding can be rotated downwardly to release each of the locking mechanisms, enabling the rider to simply step out of the binding. Alternatively, the rider can simply actuate the lever on the lateral side of the boot to open the lateral locking mechanism, which will provide sufficient clearance to enable the rider to step out of binding. After stepping out of the binding, the rider can actuate the lever on the medial side of the boot, either by hand or with the boot, to open the medial locking mechanism to facilitate re-entry.

Figure 8:
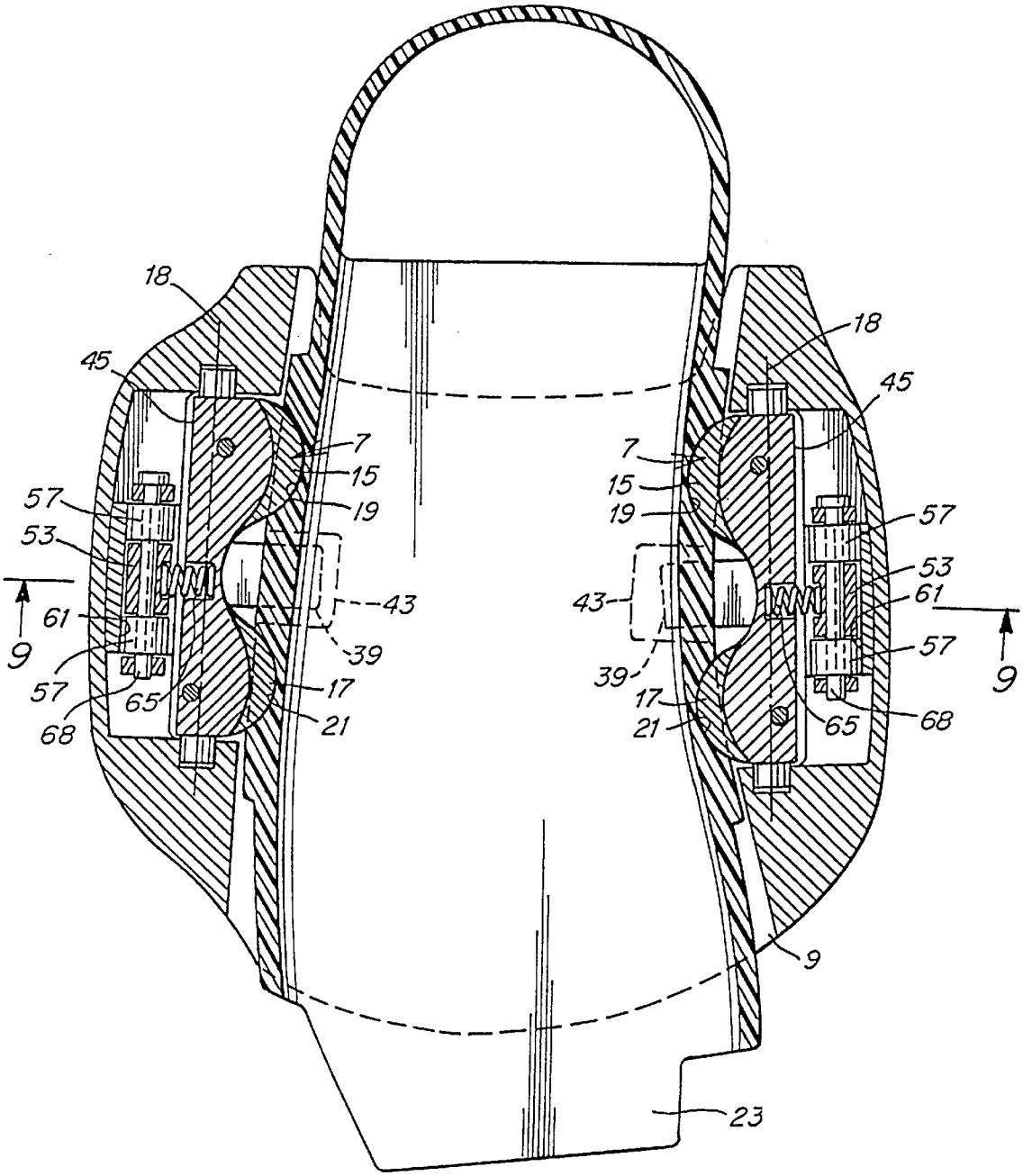
FIG. 8 is a simplified schematic top plan view that is partially broken away to show the details of the locking mechanism in accordance with one embodiment of the present invention.

FIG. 8 is a simplified schematic top view that is cut away to illustrate the manner in which the rocker 45 is mounted to the binding plate, and the manner in which the spring 65 is mounted between the arm 53 and the rocker 45. FIG. 8 also illustrates a rod 68 that passes through openings (not shown) in the arm 53 and rollers 57 and is used to mount the rollers to the arm.

Figure 9:
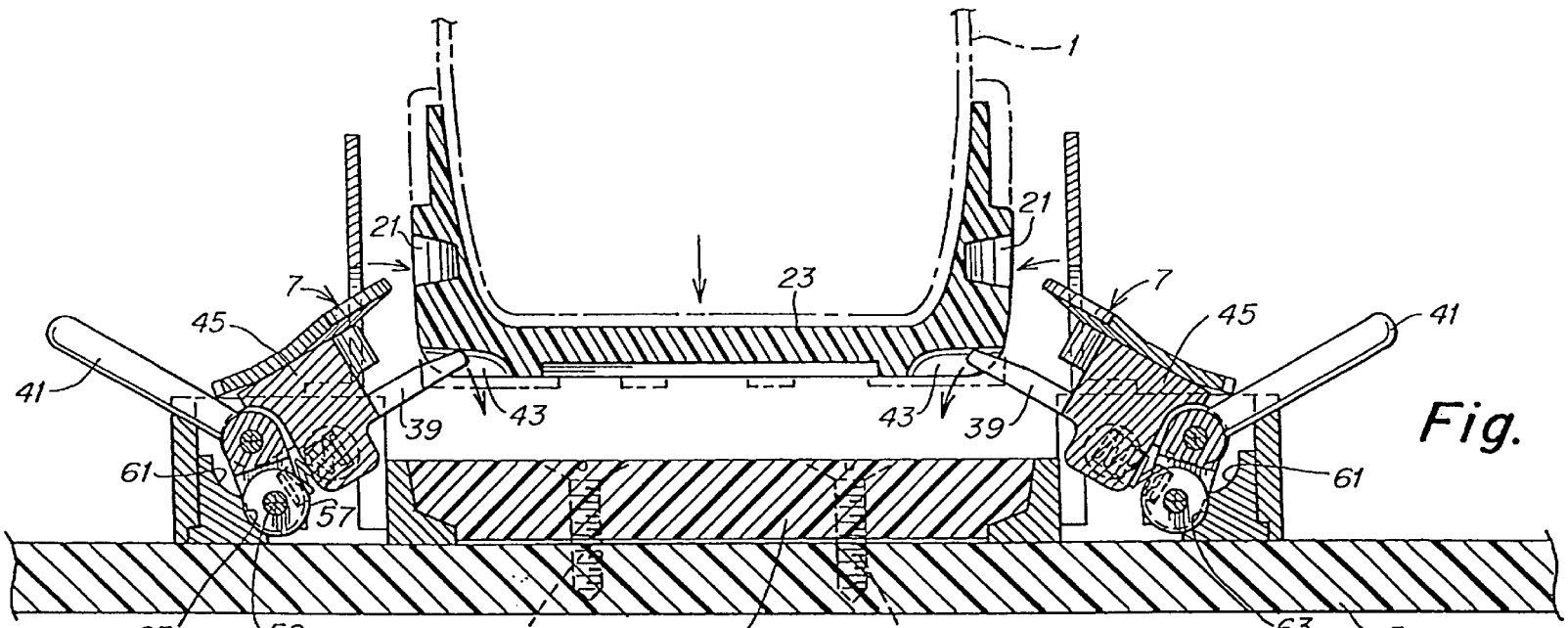
FIG. 9 is a cross-sectional view, taken along line 9—9 of FIG. 8, showing a boot stepping into the dual-lever embodiment of the present invention with both locking mechanisms in the open position.

FIGS. 9 and 10 are full cross-sectional views, taken along line 9—9 of FIG. 8, showing the manner in which the locking mechanisms on both the lateral and medial sides of the binding respond to a boot stepping into the binding by moving from the open position shown in FIG. 9 to the locked position shown in FIG. 10.

It should be understood that the present invention is not limited to the particular locking configuration shown in the figures, as other configurations are possible. However, this locking arrangement is employed in one embodiment of the invention because it provides a compact design. In particular, the locking arrangement does not extend a significant distance laterally from the sides of the binding, which is advantageous in any binding arrangement, but particularly so where the binding includes locking mechanisms on both the medial and lateral sides. For example, the arm 53 that acts to prevent rocker rotation when the binding is locked extends primarily in a vertical, rather than horizontal, direction. Thus, when the binding is in the closed position of FIG. 6A, an angle H at which the arm's axis is disposed relative to vertical is relatively small. This angle is preferably no greater than 30°, and in one embodiment of the invention is equal to approximately 19°.

In one embodiment of the invention, a number of the components used to form the locking mechanisms on the medial and lateral sides of the binding are shared to reduce manufacturing costs. In particular, single components can be used to form each of the engagement member 7, arm 53, rollers 57, cammed sockets 61, 63 and spring 65 on the medial and lateral sides of the binding for both the left and right foot. In one embodiment of the invention, separate components are used on the medial and lateral sides of the binding for the rocker 45, but the medial and lateral rockers can each be used in both the left and right binding.

An alternate embodiment of the invention is shown making reference to FIGS. 11–14. This embodiment is similar in many respects to the embodiment described above and like reference characters are used to describe similar elements. The primary difference between the embodiment of FIGS. 11–14 and that described above is that the dual-lever arrangement has been replaced with a single lever 91 that is used to actuate both moveable engagement members.

In the embodiment shown in FIGS. 11–14, the locking mechanism for the binding is provided with a coupling mechanism that prevents either side of the binding from locking unless and until the other side is ready to go into the locked position. This feature of the single-lever embodiment of the invention is advantageous in preventing a rider from inadvertently locking one side of the binding, getting a visual indication from the lever that the binding appears to be locked, and only after beginning a ride discovering that the boot is not secured in the binding. This is not a concern in the dual-lever embodiment described above, because each lever provides an independent visual indicator to the rider that its side of the binding is locked.

The single lever 91 is mounted to an extension 93 (FIGS. 12–14) of the binding plate about a pivot axis 95. The lever 91 is further pivotally mounted to a pair of links 97 and 99 that are respectively coupled to the locking mechanism arms 53 on the lateral and medial sides of the binding. The link 97 is pivotally mounted to the arm 53 on the lateral side of the binding about a pivot axis 101 that is aligned with the axis about which the rollers 57 are mounted to the lateral link 53. Similarly, the link 99 is mounted to the arm 53 on the medial side of the binding about a pivoting axis 103 that is aligned with the rollers 57 of the locking mechanism on the medial side. The link 99 is articulated at 105 for reasons that are discussed below.

Figure 12:
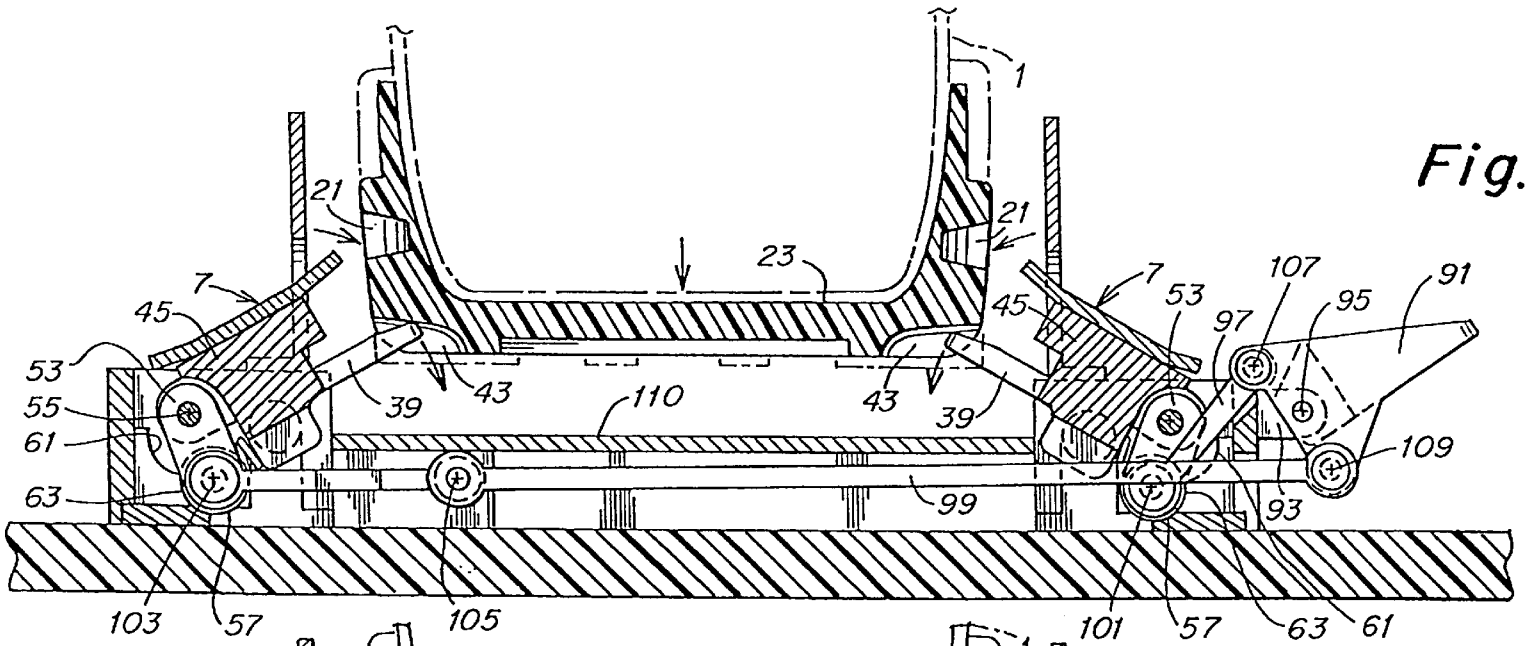
FIG. 12 is a cross-sectional view, taken along line 12—12 of FIG. 11, showing the single-lever embodiment in the open configuration.
Figure 13:
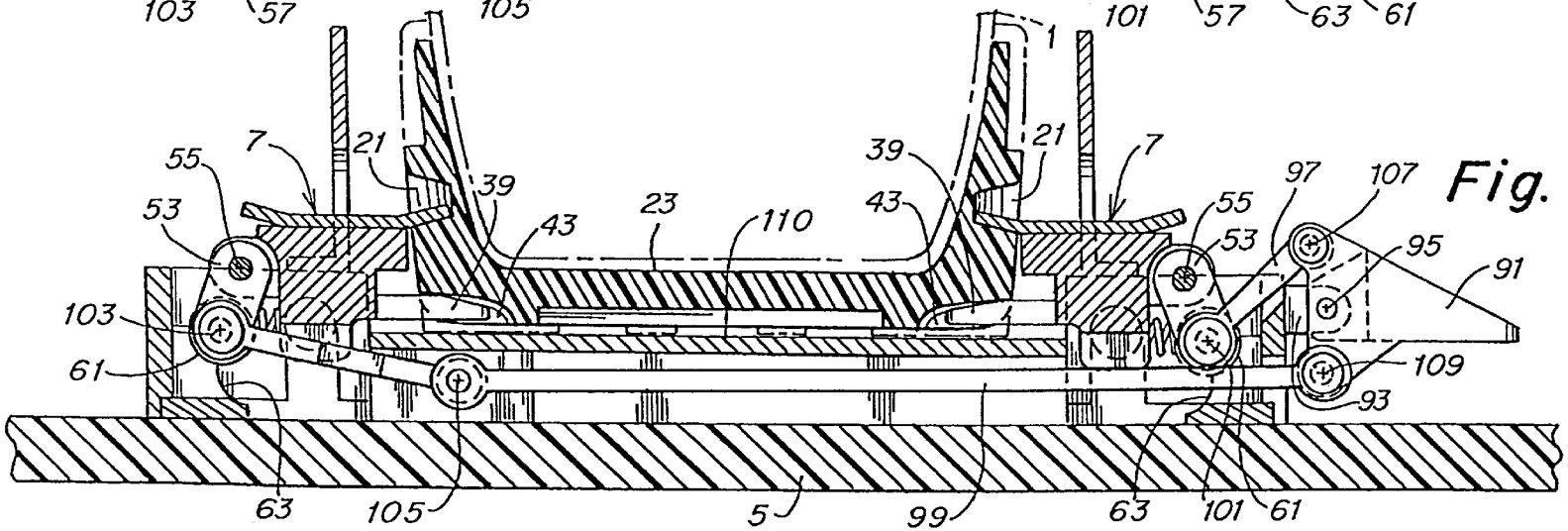
FIG. 13 is a cross-sectional view, taken along line 12—12 of FIG. 11, showing the single-lever embodiment in the closed configuration.

The coupling of the lever 91 to the arms 53 of the locking mechanisms on both sides of the binding through the links 97 and 99 prevents either locking mechanism from locking unless and until the other is also ready to enter the locked position. FIGS. 12 and 13 respectively show the binding in its open and locked configurations. As seen from FIG. 12, when the binding is open, the lever 91 is rotated counterclockwise about its pivot axis 95 into a position such that a connection point 107 on the lever wherein link 97 is attached rotates downwardly, enabling the roller 57 attached to the other end of the link 97 to be seated in the lower cammed socket 61. Similarly, in this configuration, the attachment point 109 wherein link 99 is attached to the lever is positioned so that the link 99 can extend fully from the lever 91 to the medial arm 53 when the medial roller 57 is also seated in the lower cammed surface 61.

By contrast, in the locked position shown in FIG. 13, the lever 91 has rotated in the clockwise direction about its pivot axis 95, causing the attachment point 107 for link 97 to move upwardly away from the cammed sockets 61 and 63, and causing the attachment point 109 for link 99 to rotate toward the cammed sockets 61 and 63 on the medial side of the binding. Thus, as the rider steps down on the trigger 39 on both sides of the binding, the rockers 45 of the locking mechanisms rotate downwardly in the manner described above in connection with the dual-lever embodiment, until the unstable position is reached with the rollers 57 adjacent the peaks between the cammed sockets 61 and 63. When this unstable ready-to-lock position is reached on both sides of the binding, the springs 57 actively trigger the locking mechanisms into their closed positions. As the locking mechanisms move from the unstable to the locked position, the arm 53 on the lateral side of the binding rotates counterclockwise about its pivot axis 55, which pushes the link 97 and causes it to act on the lever 91 so that the lever rotates in a clockwise direction about its pivot axis 95. Similarly, as the locking mechanism on the medial side of the binding moves into the locked position, the link 53 rotates clockwise about its pivot axis 55, thereby pulling on the link 99, which also acts on the lever 91 to rotate it in the clockwise direction about its pivot axis 95 into the closed position shown in FIG. 13. As seen from FIG. 13, in the closed position, the link 99 extends from its attachment point 109 on the lever, wherein it is below the boot receiving surface 110 of the baseplate, to the attachment point 103 on the medial lever 53 which is above the plane of the baseplate surface 110. The articulation 105 enables the link 99 to extend between these two points in the closed configuration without passing through the baseplate boot receiving surface 110.

Figure 14:
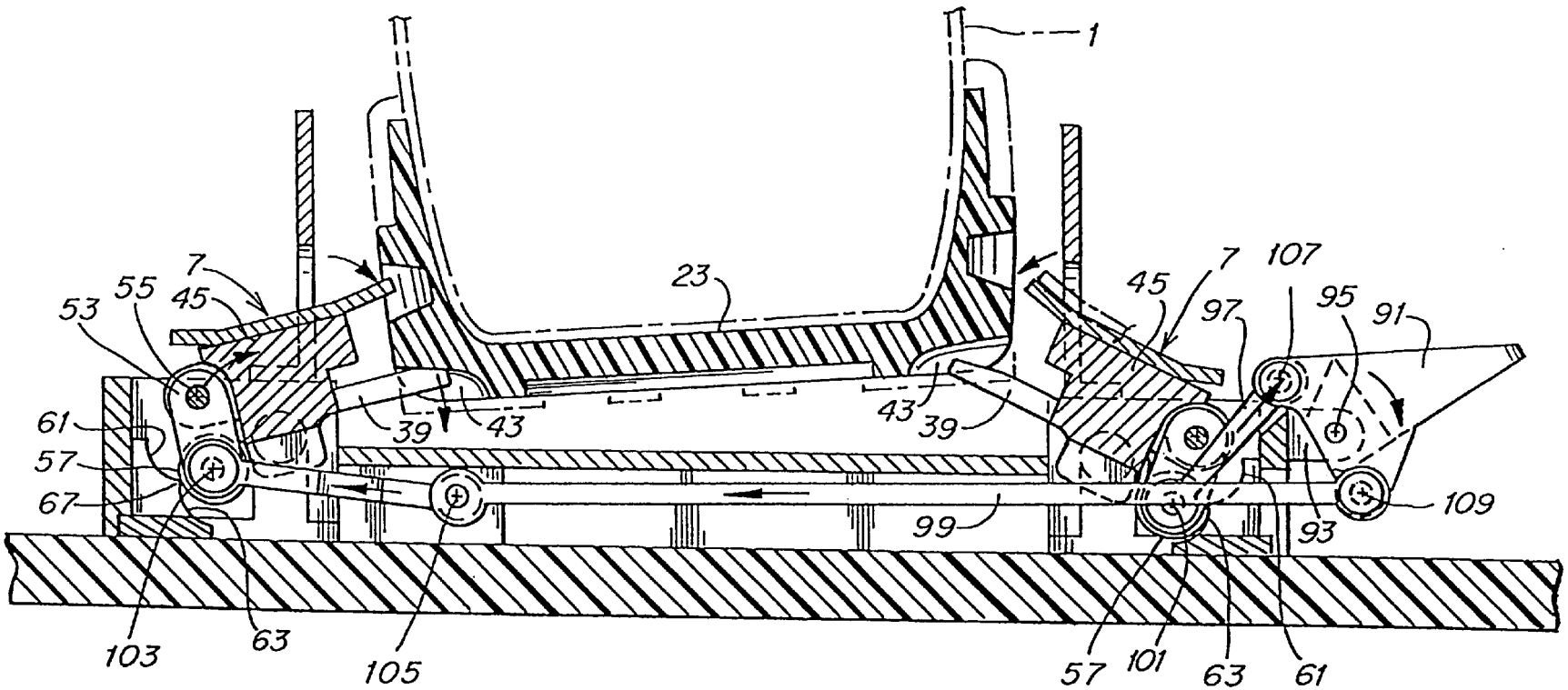
FIG. 14 is a cross-sectional view, taken along line 12—12 of FIG. 11, showing the single-lever embodiment of the present invention preventing the locking mechanism on the medial side of the binding from locking because the locking mechanism on the lateral side has not yet reached the ready-to-lock position.

As should be seen from the foregoing, each of the links 97 and 99 is coupled to the lever, such that if one of the locking arms 53 is in the open position and not ready to lock, it keeps the lever from reaching the closed position, which in turn keeps the other arm 53 from going over center and reaching the locked state. This advantageous feature of the embodiment of FIGS. 11–14 is shown in FIG. 14, wherein the locking mechanism on the medial side of the binding has been depressed more quickly than on the lateral side, and has reached the unstable ready-to-lock position. However, since the locking mechanism on the lateral side of the binding has not reached the ready-to-lock position, the link 97 prevents the lever 91 from rotating in the clockwise direction, which in turn prevents the link 99 from moving toward the medial side of the binding. Thus, the link 99 prevents the arm 53 on the medial side of the binding from raising the roller 53 into the upper cammed socket 63. This can only occur when the locking mechanism on the lateral side of the binding has also reached the ready-to-lock position as discussed above.

In the embodiment shown in the figures, the lever 91 is disposed on the lateral side of the binding for ease of access. However, it should be understood that the invention is not limited in this respect, and that the lever can alternatively be positioned on the medial side of the binding.

It should be understood that with the exception of the use of a single lever 91 and the attached links 97 and 99, the single-lever embodiment of FIGS. 11–14 is identical to the dual-lever embodiment discussed above, and can optionally include all of the optional advantageous features and alternative arrangements discussed above in connection with the dual-lever embodiment.

Although in the illustrative embodiments discussed above the engagement members 7 are rotatable relative to the binding plate to move from the open to the closed configuration, it should be understood that the present invention is not limited in this respect. To facilitate stepping into a binding with a high-back attached thereto, one advantageous feature of the present invention is that the engagement members on both sides of the boot are moveable so that they each can move into engagement with the boot as it steps into the binding, without requiring that mating between one of the engagement members and the boot be accomplished prior to triggering the other engagement member. In addition to the rotatable engagement members 7 disclosed herein, it should be understood that similar advantages can be achieved with engagement members that slide or otherwise move relative to the binding plate 9 between open and closed configurations.

As stated above, a number of the binding components (e.g., the engagement member 7) can be made from metal. The present invention is not limited to any particular type of metals, but examples include stainless steel, carbon steel and aluminum. Similarly, a number of the components can be formed from any suitable molded plastic material. In one embodiment of the invention, the molded plastic parts are formed from long fiber glass filled materials, such as nylon, polyurethane, polycarbonate and polypropylene. Long fiber glass filled materials are advantageous in that they maintain their impact strength at relatively cold temperatures where other materials may become brittle. However, the present invention is not limited to use with such materials.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. A step-in snowboard binding for securing a snowboard boot to a snowboard, comprising:

a base;

a heel hoop supported by the base;

at least one strapless engagement member, moveably mounted to the base, adapted to engage at least one lateral side of the snowboard boot and to resist a heel of the snowboard boot from lifting relative to the base; and a high-back leg support supported by the heel hoop;

wherein the at least one strapless engagement member includes:

a first strapless engagement member, moveably mounted to the base, adapted to engage a lateral side of the snowboard boot; and a second strapless engagement member, mounted to the base opposite the first strapless engagement member, whereby first and second strapless engagement members cooperate to resist the heel of the snowboard boot from lifting from the snowboard;

wherein the first strapless engagement member is mounted for rotation relative to the base; and wherein the second strapless engagement member is mounted for rotation relative to the base.

2. The snowboard binding of claim 1, wherein each of the first and second strapless engagement members is arranged to engage a mid-section of the snowboard boot.

3. The snowboard binding of claim 1, wherein the base has a baseplate adapted to be mounted to the snowboard, and the high-back leg support is mounted to the binding for rotation about an axis that is substantially normal to the baseplate.

4. The snowboard binding of claim 1, wherein a position of the heel hoop is adjustable relative to the at least one strapless engagement member to accommodate different sizes of the snowboard boot.

5. The snowboard binding of claim 1, wherein the base includes a baseplate adapted to be mounted to the snowboard, and the high-back leg support is supported by the heel hoop so that a surface of the heel hoop that engages with the high-back leg support to resist rearward rotation thereof is raised up from the baseplate.

6. The snowboard binding of claim 1, wherein the heel hoop is mounted to the base at a pair of attachment points on a first lateral side of the base.

7. The snowboard binding of claim 6, wherein the heel hoop is mounted to the base at a pair of attachment points on a second lateral side of the base.

8. The snowboard binding of claim 7, wherein the heel hoop is mounted to the base with a pair of screws on each lateral side of the base.

9. The snowboard binding of claim 1, wherein the second strapless engagement member is adapted to engage a second lateral side of the snowboard boot opposite the first lateral side.

10. The snowboard binding of claim 1, wherein the first strapless engagement member is movable between a closed position wherein it secures the snowboard boot to the binding and an open position wherein it does not secure the snowboard boot to the binding.

11. The snowboard binding of claim 10, further including a spring that biases the first strapless engagement member from an intermediate position into the closed position.

12. The snowboard binding of claim 1, wherein the second engagement member is movable between a closed position wherein it secures the snowboard boot to the binding and an open position wherein it does not secure the snowboard boot to the binding, the binding further includes a single handle adapted to move the first and second strapless engagement members from the closed positions to the open positions, the handle being mechanically coupled to first and second strapless engagement members.

13. The snowboard binding of claim 1, wherein each of the first and second strapless engagement members is movable between an open position and a closed position, and wherein the binding further includes a linkage that mechanically couples the first strapless engagement member to the second strapless engagement member and is arranged to prevent the first strapless engagement member from reaching its closed position unless the second strapless engagement member is ready to enter its closed position.

14. The snowboard binding of claim 1, in combination with the snowboard boot.

15. The combination of claim 14, wherein the boot is free of a mating feature to engage with the binding in an area behind a heel of the boot.

16. The combination of claim 14, wherein the boot is free of a mating feature to engage with the binding in an area other than the mid-section area.

17. The combination of claim 14, wherein the boot is flexible forward of a ball area to facilitate walking.

18. The combination of claim 14, wherein the boot is a soft snowboard boot.

19. The combination of claim 14, wherein the snowboard boot includes an interface disposed on the snowboard boot, the at least one strapless engagement member being adapted to engage the interface to secure the snowboard boot to the binding.

20. The combination of claim 19, wherein the interface forms openings for respectively receiving the first and second strapless engagement members when the first and second strapless engagement members are in the closed configuration.

21. The combination of claim 19, wherein the interface is disposed in a mid-section area of the boot.

22. The combination of claim 19, wherein the interface terminates rearward of the toe area of the boot.

23. The combination of claim 19, wherein the interface is supported by the sole of the snowboard boot.

24. The combination of claim 19, wherein the interface is embedded in the sole of the boot.

25. The snowboard binding of claim 1, wherein the binding is free of an engagement member to engage the snowboard boot forward of a mid-section of the snowboard boot.

26. The snowboard binding of claim 1, wherein the at least one strapless engagement member is mounted to the base at a mounting location spaced from the heel hoop and the high-back leg support.

27. The snowboard binding of claim 1, wherein the second strapless engagement member is adapted to engage a second lateral side of the snowboard boot opposite the first lateral side and wherein each of the first and second strapless engagement members is arranged to engage a mid-section of the snowboard boot, each of the first and second strapless engagement members being movable between a closed position wherein they secure the snowboard boot to the binding and an open position wherein they do not secure the snowboard boot to the binding, the binding further including:

a single handle adapted to move the first and second strapless engagement members from the closed positions to the open positions, the handle being mechanically coupled to the first and second strapless engagement members.

28. The snowboard binding of claim 27, in combination with the snowboard boot, wherein the snowboard boot includes an interface supported by the sole of the snowboard boot that is disposed in a mid-section area of the boot, the first and second strapless engagement members being adapted to engage, from above, at least a portion of the interface to resist lifting forces generated on the snowboard boot to secure the snowboard boot to the binding, and wherein the boot is a soft snowboard boot.

29. The snowboard binding of claim 27, wherein the heel hoop is mounted to the base at a pair of attachment points on a first lateral side of the base and at a pair of attachment points on a second lateral side of the base such that a position of the heel hoop is adjustable relative to the engagement members to accommodate different sizes of the snowboard boot.

30. A step-in snowboard binding for securing a snowboard boot to a snowboard, comprising:

a base;

a heel hoop supported by the base;

at least one strapless engagement member, moveably mounted to the base, adapted to engage at least one lateral side of the snowboard boot and to resist a heel of the snowboard boot from lifting relative to the base; and a high-back leg support supported by the heel hoop;

wherein the at least one strapless engagement member includes:

a first strapless engagement member, moveably mounted to the base, adapted to engage a first lateral side of the snowboard boot; and a second strapless engagement member, mounted to the base opposite the first strapless engagement member, whereby the first and second strapless engagement members cooperate to resist the heel of the snowboard boot from lifting from the snowboard;

wherein the first strapless engagement member is mounted for rotation relative to the base; and wherein the first strapless engagement member pivots about an axis substantially parallel with a longitudinal axis of the binding.

31. The snowboard binding of claim 30, wherein the binding is free of an engagement member to engage the snowboard boot forward of a mid-section of the snowboard boot.

32. The snowboard binding of claim 30, wherein the at least one strapless engagement member is mounted to the base at a mounting location spaced from the heel hoop and the high-back leg support.

33. The snowboard binding of claim 30, wherein each of the first and second strapless engagement members is arranged to engage a mid-section of the snowboard boot.

34. The snowboard binding of claim 30, wherein a position of the heel hoop is adjustable relative to the at least one strapless engagement member to accommodate different sizes of the snowboard boot.

35. The snowboard binding of claim 30, wherein the base includes a baseplate adapted to be mounted to the snowboard, and the high-back leg support is supported by the heel hoop so that a surface of the heel hoop that engages with the high-back leg support to resist rearward rotation thereof is raised up from the baseplate.

36. The snowboard binding of claim 30, wherein the second strapless engagement member is adapted to engage a second lateral side of the snowboard boot opposite the first lateral side.

37. The snowboard binding of claim 30, wherein the second strapless engagement member is moveably mounted to the base.

38. The snowboard binding of claim 30, wherein the first strapless engagement member is movable between a closed position wherein it secures the snowboard boot to the binding and an open position wherein it does not secure the snowboard boot to the binding and wherein the binding further includes a spring that biases the first strapless engagement member from an intermediate position into the closed position.

39. The snowboard binding of claim 30, wherein the second strapless engagement member is adapted to engage a second lateral side of the snowboard boot opposite the first lateral side and wherein each of the first and second strapless engagement members is arranged to engage a mid-section of the snowboard boot, and wherein the heel hoop is mounted to the base such that a position of the heel hoop is adjustable relative to the engagement members to accommodate different sizes of the snowboard boot.

40. The snowboard binding of claim 39, in combination with the snowboard boot, wherein the snowboard boot includes an interface supported by the sole of the snowboard boot that is disposed in a mid-section area of the boot, the first and second strapless engagement members being adapted to engage at least a portion of the interface to resist lifting forces generated on the snowboard boot to secure the snowboard boot to the binding, and wherein the boot is a soft snowboard boot.

41. The snowboard binding of claim 40, wherein the interface is embedded in the sole of the snowboard boot.

42. The snowboard binding of claim 30, in combination with the snowboard boot.

43. The combination of claim 42, wherein the boot is free of a mating feature to engage with the binding in an area behind a heel of the boot.

44. The combination of claim 42, wherein the boot is free of a mating feature to engage with the binding in an area other than the mid-section area.

45. The combination of claim 42, wherein the boot is flexible forward of a ball area to facilitate walking.

46. The combination of claim 42, wherein the boot is a soft snowboard boot.

47. The combination of claim 42, wherein the snowboard boot includes an interface disposed on the snowboard boot, the at least one strapless engagement member being adapted to engage the interface to secure the snowboard boot to the binding.

48. The combination of claim 47, wherein the interface forms at least one opening for receiving the at least one strapless engagement member when the at least one strapless engagement member is in the closed configuration.

49. The combination of claim 47, wherein the interface is supported by the sole of the snowboard boot.

50. The combination of claim 47, wherein the at least one strapless engagement member is arranged to engage, from above, at least a portion of the interface to resist lifting forces generated on the snowboard boot.

51. The combination of claim 47, wherein the interface is disposed in a mid-section area of the boot.

52. The combination of claim 47, wherein the interface is embedded in the sole of the boot.

53. The combination of claim 47, wherein the interface terminates rearward of the toe area of the boot.

54. A step-in snowboard binding for securing a snowboard boot to a snowboard, the binding comprising:

a base adapted to receive the snowboard boot;

at least one strapless engagement member mounted to the base for movement between an open position and a closed position wherein the at least one strapless engagement member engages the snowboard boot to resist a heel of the boot from lifting relative to the base; and a heel hoop adapted to receive a heel of the snowboard boot, the heel hoop being adjustably mounted to the base to enable adjustment of a distance separating the heel hoop and the at least one strapless engagement member in a length direction of the binding to enable the binding to accommodate different sizes of the snowboard boot;

wherein the heel hoop is mounted to the base at at least one attachment point that is forward of the at least one strapless engagement member.

55. The snowboard binding of claim 54, further including a high-back leg support supported by the heel hoop.

56. The snowboard binding of claim 55, wherein the at least one strapless engagement member is mounted to the base at a mounting location spaced from the heel hoop and the high-back leg support.

57. The snowboard binding of claim 55, wherein the base includes a baseplate adapted to be mounted to the snowboard, and the high-back leg support is supported by the heel hoop so that a surface of the heel hoop that engages with the high-back leg support to resist rearward rotation thereof is raised up from the baseplate.

58. The snowboard binding of claim 54, wherein the heel hoop is mounted to the base at a pair of attachment points on a same side of the base, the pair of attachment points including a forward attachment point that is forward of the at least one strapless engagement member and a rearward attachment point that is rearward of the at least one strapless engagement member.

59. The snowboard binding of claim 58, wherein the at least one strapless engagement member is disposed on the side of the base, and wherein the heel hoop includes a portion that spans the forward and rearward attachment points and is disposed above the at least one strapless engagement member.

60. The snowboard binding of claim 54, wherein the at least one strapless engagement member is adapted to engage a side of the snowboard boot.

61. The snowboard binding of claim 54, wherein the at least one strapless engagement member is mounted for rotation relative to the base.

62. The snowboard binding of claim 54, in combination with the snowboard boot.

63. The combination of claim 62, wherein the snowboard boot includes an interface disposed on the snowboard boot, the at least one strapless engagement member being adapted to engage the interface to secure the snowboard boot to the binding.

64. The combination of claim 63, wherein the interface is supported by the sole of the snowboard boot.

65. The combination of claim 63, wherein the interface forms at least one opening for receiving the at least one strapless engagement member when the at least one strapless engagement member is in the closed configuration.

66. The combination of claim 63, wherein the at least one strapless engagement member is arranged to engage, from above, at least a portion of the interface to resist lifting forces generated on the snowboard boot.

67. The combination of claim 62, wherein the boot is a soft snowboard boot.

68. The combination of claim 62, wherein the boot is free of a mating feature to engage with the binding in an area other than the mid-section area.

69. The combination of claim 62, wherein the boot has at least one recess adapted to receive the at least one strapless engagement member.

70. The combination of claim 62, wherein the boot is free of a mating feature to engage with the binding in an area behind a heel of the boot.

71. The snowboard binding of claim 54, wherein the heel hoop is mounted to the base at a pair of attachment points on a first lateral side of the base.

72. The snowboard binding of claim 71, wherein the heel hoop is mounted to the base at a pair of attachment points on a second lateral side of the base.

73. The snowboard binding of claim 72, wherein the heel hoop is mounted to the base with a pair of screws on each lateral side of the base.

74. The snowboard binding of claim 54, further including a spring that biases the at least one strapless engagement member from an intermediate position into the closed position.

75. The snowboard binding of claim 54, wherein the base has a baseplate adapted to be mounted to the snowboard, a high-back leg support being mounted to the binding for rotation about an axis that is substantially normal to the baseplate and being supported by the heel hoop so that a surface of the heel hoop that engages with the high-back leg support to resist rearward rotation thereof is raised up from the baseplate; and wherein the heel hoop is mounted to the base at a pair of attachment points on a first lateral side of the base and at a pair of attachment points on a second lateral side of the base such that a position of the heel hoop is adjustable relative to the at least one engagement member to accommodate different sizes of the snowboard boot, wherein the pair of attachment points on the first lateral side of the base includes a forward attachment point that is forward of the at least one strapless engagement member and wherein the pair of attachment points on the second lateral side of the base includes a forward attachment point that is forward of the at least one strapless engagement member.

76. The snowboard binding of claim 75, in combination with the snowboard boot, the snowboard boot including an interface supported by the sole of the snowboard boot, the at least one strapless engagement member being adapted to engage at least a portion of the interface to resist lifting forces generated on the snowboard boot to secure the snowboard boot to the binding, wherein the boot is free of a mating feature to engage with the binding in an area behind a heel of the boot, and wherein the boot is a soft snowboard boot.

77. A step-in snowboard binding for securing a snowboard boot to a snowboard, the binding comprising:

a base adapted to receive the snowboard boot;

at least one strapless engagement member mounted to the base for movement between an open position and a closed position wherein the at least one strapless engagement member engages the snowboard boot to resist a heel of the boot from lifting relative to the base; and a heel hoop adapted to receive a heel of the snowboard boot, the heel hoop being adjustably mounted to the base to enable adjustment of a distance separating the heel hoop and the at least one strapless engagement member in a length direction of the binding to enable the binding to accommodate different sizes of the snowboard boot;

wherein the at least one strapless engagement member is pivotally mounted to the base about an axis that is substantially parallel to the length direction of the snowboard binding.

78. The snowboard binding of claim 77, wherein the at least one strapless engagement member is arranged to engage a mid-section of the snowboard boot.

79. The snowboard binding of claim 77, further including a high-back leg support supported by the heel hoop.

80. The snowboard binding of claim 79, wherein the base includes a baseplate adapted to be mounted to the snowboard, and the high-back leg support is supported by the heel hoop so that a surface of the heel hoop that engages with the high-back leg support to resist rearward rotation thereof is raised up from the baseplate.

81. The snowboard binding of claim 79, wherein the at least one strapless engagement member is mounted to the base at a mounting location spaced from the heel hoop and the high-back leg support.

82. The snowboard binding of claim 77, wherein the at least one strapless engagement member includes a first engagement member adapted to engage a first lateral side of the snowboard boot and a second engagement member adapted to engage a second lateral side of the snowboard boot.

83. The snowboard binding of claim 77, wherein the at least one strapless engagement member includes a first engagement member adapted to engage a first lateral side of the snowboard boot and a second engagement member mounted to the base opposite the first engagement member.

84. The snowboard binding of claim 83, wherein first engagement member is movably mounted to the base.

85. The snowboard binding of claim 77, further including a spring that biases the at least one strapless engagement member from an intermediate position into the closed position.

86. The snowboard binding of claim 77, wherein the heel hoop is mounted to the base at a pair of attachment points on a first lateral side of the base.

87. The snowboard binding of claim 86, wherein the heel hoop is mounted to the base at a pair of attachment points on a second lateral side of the base.

88. The snowboard binding of claim 87, wherein the heel hoop is mounted to the base with a pair of screws on each lateral side of the base.

89. The snowboard binding of claim 77, wherein the at least one strapless engagement member is adapted to engage a side of the snowboard boot.

90. The snowboard binding of claim 77, wherein the at least one strapless engagement member includes a first strapless engagement member, moveably mounted to the base, adapted to engage a first lateral side of the snowboard boot and a second strapless engagement member mounted to the base and adapted to engage a second lateral side of the snowboard boot opposite the first lateral side, whereby the first and second strapless engagement members cooperate to resist the heel of the snowboard boot from lifting from the snowboard, wherein each of the first and second strapless engagement members is arranged to engage a mid-section of the snowboard boot, the first strapless engagement member being movable between a closed position wherein it secures the snowboard boot to the binding and an open position wherein it does not secure the snowboard boot to the binding, wherein the base has a baseplate adapted to be mounted to the snowboard, a high-back leg support being mounted to the binding for rotation about an axis that is substantially normal to the baseplate and being supported by the heel hoop so that a surface of the heel hoop that engages with the high-back leg support to resist rearward rotation thereof is raised up from the baseplate.

91. The snowboard binding of claim 90, in combination with the snowboard boot, wherein the snowboard boot includes an interface supported by the sole of the snowboard boot that is disposed in a mid-section area of the boot, the first and second strapless engagement members being adapted to engage at least a portion of the interface to resist lifting forces generated on the snowboard boot to secure the snowboard boot to the binding, and wherein the boot is a soft snowboard boot.

92. The snowboard binding of claim 91, wherein the interface is embedded in the sole of the snowboard boot.

93. The snowboard binding of claim 77, in combination with the snowboard boot.

94. The combination of claim 93, wherein the snowboard boot includes an interface disposed on the snowboard boot, the at least one strapless engagement member being adapted to engage the interface to secure the snowboard boot to the binding.

95. The combination of claim 94, wherein the interface is supported by the sole of the snowboard boot.

96. The combination of claim 94, wherein the at least one strapless engagement member is arranged to engage, from above, at least a portion of the interface to resist lifting forces generated on the snowboard boot.

97. The combination of claim 94, wherein the interface forms at least one opening for receiving the at least one strapless engagement member when the at least one strapless engagement member is in the closed configuration.

98. The combination of claim 94, wherein the interface terminates rearward of the toe area of the boot.

99. The combination of claim 93, wherein the boot is free of a mating feature to engage with the binding in an area behind a heel of the boot.

100. The combination of claim 93, wherein the boot is free of a mating feature to engage with the binding in an area other than the mid-section area.

101. The combination of claim 93, wherein the boot is flexible forward of a ball area to facilitate walking.

102. The combination of claim 93, wherein the boot is a soft snowboard boot.

103. The combination of claim 94, wherein the interface is disposed in a mid-section area of the boot.

104. The combination of claim 94, wherein the interface is embedded in the sole of the boot.

105. A step-in snowboard binding for securing a snowboard boot to a snowboard, the binding comprising:

a base adapted to receive the snowboard boot;

at least one strapless engagement member mounted to the base for movement between an open position and a closed position wherein the at least one strapless engagement member engages the snowboard boot to resist a heel of the boot from lifting relative to the base; and a heel hoop adapted to receive a heel of the snowboard boot, the heel hoop being adjustably mounted to the base to enable adjustment of a distance separating the heel hoop and the at least one strapless engagement member in a length direction of the binding to enable the binding to accommodate different sizes of the snowboard boot;

wherein the at least one strapless engagement member includes a first engagement member adapted to engage a first lateral side of the snowboard boot and a second engagement member adapted to engage a second lateral side of the snowboard boot; and wherein each of the first and second engagement members is mounted for rotation relative to the base.

106. The snowboard binding of claim 105, wherein each of the first and second strapless engagement members is arranged to engage a mid-section of the snowboard boot.

107. The snowboard binding of claim 105, further including a high-back leg support supported by the heel hoop.

108. The snowboard binding of claim 107, wherein the at least one strapless engagement member is mounted to the base at a mounting location spaced from the heel hoop and the high-back leg support.

109. The snowboard binding of claim 105, wherein the heel hoop is mounted to the base at a pair of attachment points on a first lateral side of the base.

110. The snowboard binding of claim 109, wherein the heel hoop is mounted to the base at a pair of attachment points on a second lateral side of the base.

111. The snowboard binding of claim 110, wherein the heel hoop is mounted to the base with a pair of screws on each lateral side of the base.

112. The snowboard binding of claim 105, further including a spring that biases the first strapless engagement member from an intermediate position into the closed position.

113. The snowboard binding of claim 105, wherein each of the first and second strapless engagement members is movable between an open position and a closed position, and wherein the binding further includes a linkage that mechanically couples the first strapless engagement member to the second strapless engagement member and is arranged to prevent the first strapless engagement member from reaching its closed position unless the second strapless engagement member is ready to enter its closed position.

114. The snowboard binding of claim 105, wherein the binding is free of an engagement member to engage the snowboard boot forward of a mid-section of the snowboard boot.

115. The snowboard binding of claim 105, wherein the binding further includes a single handle adapted to move the first and second strapless engagement members from the closed position to the open position, the handle being mechanically coupled to the first and second strapless engagement members.

116. The snowboard binding of claim 105, wherein each of the first and second strapless engagement members is arranged to engage a mid-section of the snowboard boot, each of the first and second strapless engagement members being movable between a closed position wherein they secure the snowboard boot to the binding and an open position wherein they do not secure the snowboard boot to the binding, the binding further including:

a high-back leg support supported by the heel hoop, wherein each of the first and second strapless engagement members is mounted to the base at a location spaced from the heel hoop and the high-back leg support; and a single handle adapted to move the first and second strapless engagement members from the closed positions to the open positions, the handle being mechanically coupled to the first and second strapless engagement members.

117. The snowboard binding of claim 105, in combination with the snowboard boot.

118. The combination of claim 117, wherein the snowboard boot includes an interface disposed on the snowboard boot, the at least one strapless engagement member being adapted to engage the interface to secure the snowboard boot to the binding.

119. The combination of claim 118, wherein the interface is supported by the sole of the snowboard boot.

120. The combination of claim 118, wherein the interface is embedded in the sole of the boot.

121. The combination of claim 118, wherein the at least one strapless engagement member is arranged to engage, from above, at least a portion of the interface to resist lifting forces generated on the snowboard boot.

122. The combination of claim 118, wherein the interface is disposed in a mid-section area of the boot.

123. The combination of claim 118, wherein the interface terminates rearward of the toe area of the boot.

124. The combination of claim 117, wherein the boot is free of a mating feature to engage with the binding in an area behind a heel of the boot.

125. The combination of claim 117, wherein the boot is free of a mating feature to engage with the binding in an area other than the mid-section area.

126. The combination of claim 117, wherein the boot is flexible forward of a ball area to facilitate walking.

127. The combination of claim 117, wherein the boot is a soft snowboard boot.

128. The snowboard binding of claim 116, in combination with the snowboard boot, the snowboard boot including an interface supported by the sole of the snowboard boot that is disposed in a mid-section area of the boot and that terminates rearward of the toe area of the boot, the first and second strapless engagement members being adapted to engage at least a portion of the interface to resist lifting forces generated on the snowboard boot to secure the snowboard boot to the binding, and wherein the boot is a soft snowboard boot.

129. The snowboard binding of claim 116, wherein the heel hoop is mounted to the base at a pair of attachment points on a first lateral side of the base and at a pair of attachment points on a second lateral side of the base.

130. A step-in snowboard binding for securing a snowboard boot to a snowboard, in combination with the snowboard boot, the binding comprising:

a base adapted to receive the snowboard boot;

at least one strapless engagement member mounted to the base for movement between an open position and a closed position wherein the at least one strapless engagement member engages the snowboard boot to resist a heel of the boot from lifting relative to the base; and a heel hoop adapted to receive a heel of the snowboard boot, the heel hoop being adjustably mounted to the base to enable adjustment of a distance separating the heel hoop and the at least one strapless engagement member in a length direction of the binding to enable the binding to accommodate different sizes of the snowboard boot;

wherein the snowboard boot includes an interface disposed on the snowboard boot, the at least one strapless engagement member being adapted to engage the interface to secure the snowboard boot to the binding; and wherein the at least one strapless engagement member is arranged to engage, from above, at least a portion of the interface to resist lifting forces generated on the snowboard boot.

131. The combination of claim 130, further including a high-back leg support supported by the heel hoop.

132. The combination of claim 131, wherein the base includes a baseplate adapted to be mounted to the snowboard, and the high-back leg support is supported by the heel hoop so that a surface of the heel hoop that engages with the high-back leg support to resist rearward rotation thereof is raised up from the baseplate.

133. The combination of claim 131, wherein the at least one strapless engagement member is mounted to the base at a mounting location spaced from the heel hoop and the high-back leg support.

134. The combination of claim 130, wherein the heel hoop is mounted to the base at a pair of attachment points on a first lateral side of the base.

135. The combination of claim 134, wherein the heel hoop is mounted to the base at a pair of attachment points on a second lateral side of the base.

136. The combination of claim 130, wherein the heel hoop is mounted to the base with a pair of screws on each lateral side of the base.

137. The combination of claim 130, further including a spring that biases the at least one strapless engagement member from an intermediate position into the closed position.

138. The combination of claim 130, wherein the boot is free of a mating feature to engage with the binding in an area behind a heel of the boot.

139. The combination of claim 130, wherein the at least one strapless engagement member is adapted to engage a side of the snowboard boot.

140. The combination of claim 130, wherein the interface is supported by the sole of the snowboard boot.

141. The combination of claim 130, wherein the boot is a soft snowboard boot.

142. The combination of claim 130, wherein the interface is disposed in a mid-section area of the boot.

143. The combination of claim 130, wherein the interface terminates rearward of the toe area of the boot.

144. The combination of claim 130, wherein the interface forms at least one opening for receiving the at least one strapless engagement member when the at least one strapless engagement member is in the closed configuration.

145. The combination of claim 130, wherein the at least one strapless engagement member includes a first strapless engagement member, moveably mounted to the base, adapted to engage a first lateral side of the snowboard boot and a second strapless engagement member mounted to the base and adapted to engage a second lateral side of the snowboard boot opposite the first lateral side, whereby the first and second strapless engagement members cooperate to resist the heel of the snowboard boot from lifting from the snowboard, each of the first and second strapless engagement members being movable between a closed position wherein they secure the snowboard boot to the binding and an open position wherein they do not secure the snowboard boot to the binding, the binding further including:

a high-back leg support supported by the heel hoop; and a single handle adapted to move the first and second strapless engagement members from the closed positions to the open positions, the handle being mechanically coupled to the first and second strapless engagement members.

146. The snowboard binding of claim 145, wherein the heel hoop is mounted to the base at a pair of attachment points on a first lateral side of the base and at a pair of attachment points on a second lateral side of the base.

147. The combination of claim 130, wherein the at least one strapless engagement member includes a first strapless engagement member, moveably mounted to the base, adapted to engage a first lateral side of the snowboard boot and a second strapless engagement member mounted to the base and adapted to engage a second lateral side of the snowboard boot opposite the first lateral side, whereby the first and second strapless engagement members cooperate to resist the heel of the snowboard boot from lifting from the snowboard.

148. The combination of claim 130, wherein the base has a baseplate adapted to be mounted to the snowboard, a high-back leg support being mounted to the binding for rotation about an axis that is substantially normal to the baseplate and being supported by the heel hoop so that a surface of the heel hoop that engages with the high-back leg support to resist rearward rotation thereof is raised up from the baseplate; and wherein the heel hoop is mounted to the base at a pair of attachment points on a first lateral side of the base and at a pair of attachment points on a second lateral side of the base such that a position of the heel hoop is adjustable relative to the at least one engagement member to accommodate different sizes of the snowboard boot, wherein the heel hoop is mounted to the base at a pair of attachment points on the first lateral side of the base and a pair of attachment points on the second lateral side of the base, wherein the pair of attachment points on the first lateral side of the base includes a forward attachment point that is forward of the at least one strapless engagement member and wherein the pair of attachment points on the second lateral side of the base includes a forward attachment point that is forward of the at least one strapless engagement member.

* * * * *

US006102429C1

(12) REEXAMINATION CERTIFICATE (4629th)

United States Patent

Laughlin et al.

(10) Number: US 6,102,429 C1

(45) Certificate Issued: Aug. 20, 2002

(54) STEP-IN SNOWBOARD BINDING

(75) Inventors: James Laughlin, Burlington; David J. Dodge, Williston, both of VT (US)

(73) Assignee: The Burton Corporation, Burlington, VT (US)

Reexamination Request:
No. 90/005,968, Mar. 30, 2001

Reexamination Certificate for:

| | |
|---|---|
| Patent No.: | **6,102,429** |
| Issued: | **Aug. 15, 2000** |
| Appl. No.: | **09/442,779** |
| Filed: | **Nov. 18, 1999** |

Related U.S. Application Data

(63) Continuation of application No. 08/780,721, filed on Jan. 8, 1997, which is a continuation-in-part of application No. 08/655,021, filed on May 29, 1996, now Pat. No. 5,722,680.

(51) Int. Cl.[7] ..... A63C 9/00

(52) U.S. Cl. ..... 280/617; 280/624

(58) Field of Search ..... 280/617, 618, 280/624, 625, 633, 634, 607, 14.21, 14.22, 14.24, 11.36; 36/115, 117.1, 117.3

(56) References Cited

U.S. PATENT DOCUMENTS

| | | | | |
|---|---|---|---|---|
| 5,595,396 A | * | 1/1997 | Bourdeau | 280/607 |
| 5,660,410 A | | 8/1997 | Alden | |
| 6,113,127 A | | 9/2000 | Karol | |

FOREIGN PATENT DOCUMENTS

| | | | | |
|---|---|---|---|---|
| DE | 44 16 024 C1 | * | 10/1995 | A63C/9/00 |
| DE | 296 01 682 | | 5/1996 | |
| DE | 195 04 026 C1 | * | 8/1996 | A63C/9/00 |
| EP | 0 787 512 A1 | * | 6/1997 | A63C/9/00 |
| WO | WO 96/17660 | | 6/1996 | |
| WO | WO 97/04843 | | 2/1997 | |

OTHER PUBLICATIONS

Translation of DE 29 601 682.

* cited by examiner

*Primary Examiner*—Frank Vanaman

(57) ABSTRACT

A snowboard binding for securing a snowboard boot to a snowboard. According to one aspect of the invention, the binding comprises a base, a first engagement member that is movably mounted to the base and is adapted to engage a first lateral side of the boot, and a second engagement member that is movably mounted to the base and is adapted to engage a second lateral side of the boot opposite the first lateral side of the boot. According to another aspect of the invention, the snowboard binding includes a high-back leg support mounted to the base. According to a further aspect of the invention, the binding includes a pair of engagement fingers, adapted to engage a lateral side of the boot and including a front engagement finger and a rear engagement finger, the pair of engagement fingers being pivotally mounted to the base for movement between an open position and a closed position, the pair of engagement fingers being mounted so that the rear engagement finger extends a greater distance above the baseplate than the front engagement finger when the engagement fingers are in the open position. In another aspect of the invention, the binding includes an over-center locking mechanism adapted to lock the movable engagement member in the closed position, the locking mechanism including a roller that is mechanically coupled to the movable engagement member and a cammed socket adapted to receive the roller when the movable engagement member is in the closed position.

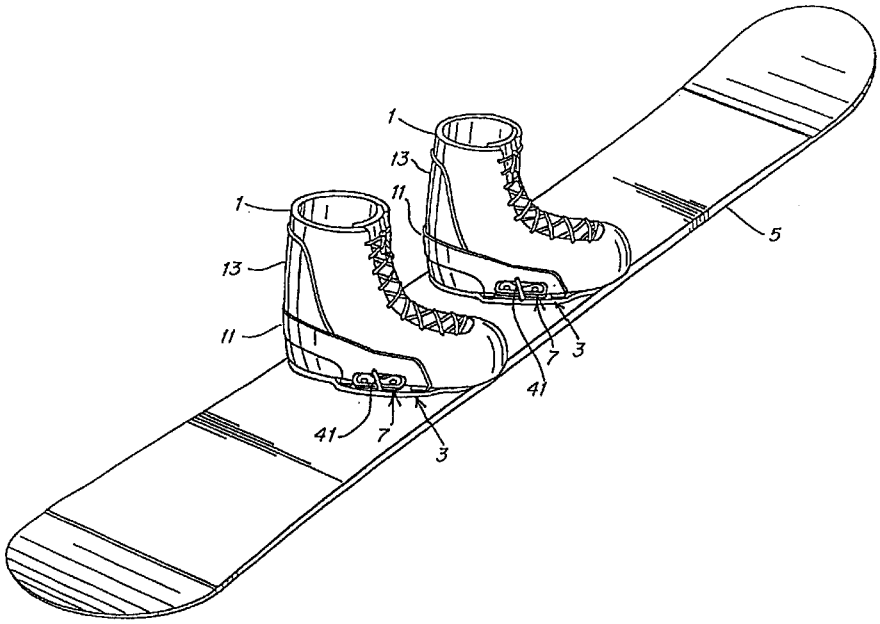

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–148 is confirmed.

* * * * *